US007147175B2

(12) United States Patent
Ikegami et al.

(10) Patent No.: US 7,147,175 B2
(45) Date of Patent: Dec. 12, 2006

(54) CRUSHING SYSTEM

(75) Inventors: Katsuhiro Ikegami, Hirakata (JP); Yasuhiro Kamoshida, Hirakata (JP)

(73) Assignee: Komatsu Ltd., Tokyo (JP)

( * ) Notice: Subject to any disclaimer, the term of this patent is extended or adjusted under 35 U.S.C. 154(b) by 255 days.

(21) Appl. No.: 10/745,055

(22) Filed: Dec. 22, 2003

(65) Prior Publication Data

US 2004/0155128 A1 Aug. 12, 2004

(30) Foreign Application Priority Data

Dec. 25, 2002 (JP) ..... 2002-374784

(51) Int. Cl.
*B02C 25/00* (2006.01)

(52) U.S. Cl. ..... 241/35; 241/36

(58) Field of Classification Search ..... 341/36, 341/35

See application file for complete search history.

(56) References Cited

U.S. PATENT DOCUMENTS 4,535,942 A 8/1985 Hayashi
4,909,449 A 3/1990 Etheridge
6,119,967 A * 9/2000 Nakayama et al. ..... 241/34

FOREIGN PATENT DOCUMENTS

JP 11-156226 A 6/1999

* cited by examiner

*Primary Examiner*—Faye Francis
(74) *Attorney, Agent, or Firm*—Frishauf, Holtz, Goodman & Chick, P.C.

(57) ABSTRACT

In a crushing system, an interlocked operation of operation units including a grizzly feeder, a crusher and a delivery conveyor and so on is stopped by depressing an interlock OFF switch (94). For this, after stopping the grizzly feeder, a stop command section (122B) outputs a stop command to the crusher and the delivery conveyor only when a load detector (110) once detects the load on the delivery conveyor and a determining section (122A) determines that the load is cleared out and there is no remaining crushed material. Thus, if compared with conventional crushing systems adapted to stop the operation units only after the elapse of a predetermined time period, the crushing system can reliably prevent the crushed material from remaining on the delivery conveyor so that it is no longer necessary to worry about a situation where the crushed material remaining on the delivery conveyor has to be removed.

13 Claims, 20 Drawing Sheets

CRUSHING SYSTEM

BACKGROUND OF THE INVENTION

1. Field of the Invention

The present invention relates to a crushing system typically consisting of a self-propelled crushing machine.

2. Description of Related Art

Conventionally, a self-propelled crushing machine is known as a crushing system. Such self-propelled crushing machine is normally systematized and adapted to operate selectively in a traveling mode for moving on lower traveling bodies, in a single operation mode where one of the operation units (grizzly feeder, crusher, delivery conveyor, etc.) to be driven and stopped alone or in an interlocked operation mode where the respective operation units are driven and stopped in a predetermined order in an interlocked manner. For operation, one of the modes is selected by a mode selection switch. (See FIGS. 7, 8 and 9 of Japanese Patent Laid-Open Publication No. Hei11-156226)

In such a system, when the interlocked operation mode is selected and an interlocked operation ON switch is pressed for a series of steps of crushing cycle, the operation units are sequentially driven to start operating with predetermined time lags from the operation unit arranged at the most downstam side, whereas the operation units are sequentially stopped with predetermined time lags from the operation unit arranged at the most upstream side when an interlocked operation OFF switch is pressed.

For instance, where a grizzly feeder, a crusher, a delivery conveyor and the like are sequentially arranged from upstream to downstream the delivery conveyor is driven to operate first and stopped last when the interlocked operation mode is selected for a crushing operation. Therefore, the crushed material crushed by the crusher would not be sent to the delivery conveyor is not driven and hence the narrow space etc. between the crusher and the delivery conveyor would normally be prevented from being clogged by the crushed material.

However, when the system disclosed in the above-described prior art is operated in an interlocked operation mode and then stopped (a situation to be also referred to as interlocked operation stop or interlocked operation OFF hereinafter), the crusher and the delivery conveyor are sequentially stopped at predetermined time intervals after the most upstream grizzly feeder is stopped. Thus, if a raw material such as natural stones that are hard and can be crushed only with large force is put into the crusher, the raw material may remain, if partly, in the crusher even when the time comes for stopping the crusher. Then, if the crusher is actually stopped under the condition, the delivery conveyor can be stopped before the crushed material is completely delivered to the outside.

In such a situation, the raw material is left in the crusher, and the crushed material remains on the delivery conveyor in an area immediately below the crusher so that the single operation mode needs to be selected to respectively drive the crusher and then the delivery conveyor to remove the crushed material when the crusher and the periphery of the crusher is inspected and an outlet port of the crusher is dimensionally regulated. It is a time consuming operation to remove the crushed material remaining there.

SUMMARY OF THE INVENTION

An object of the present invention is to provide a crushing system that can reliably prevent the crushed material from remaining in areas where the operation of removing the crushed material is time consuming even when the operation units are stopped in an interlocked operation mode.

A crushing system according to an aspect of the present invention includes: a plurality of operation units including a crusher, a stop device for stopping an interlocked operation of the operation units; a stop command section for outputting a stop command signal respectively to the plurality of operation units in a predetermined order in response to the operation of the stop device; a load detector for detecting a load of one of the plurality of operation units; and a determining section for determining the load of the operation unit on the basis of a detection signal from the load detector, in which the stop command section outputs the stop command signal on the basis of the determination made by the determining section.

In the crushing system according to the above arrangement, the respective operation units are stopped in the interlocked manner by operating the stop device. In such a situation, the load detector detects the load of the operation unit (e.g., delivery conveyor) in which it is not desirable to allow the crushed material to remain or that of the operation unit located downstream relative to the former operation unit and the determining section determines if the load is nil or sufficiently small and hence the crushed material is practically not left there. And then, the stop command section outputs stop command signal only after the above determination, thereby securely preventing the crushed material from remaining in the areas where the operation of removing the crushed material needs to be conducted in the single operation mode.

In the crushing system according to the present invention, the operation unit, the load of which is detected by the load detector, may preferably be at least one of the operation unit arranged downstream relative to the crusher.

Note that the term, "downstream" refers to a downstream position in the flow of operation including a series of steps of crushing cycle, and the term, "upstream" refers to an upstream position in the flow of operation including a series of steps of crushing cycle.

When the crushed material is remaining in an area immediately below the crusher, the crushed material can be left in a narrow space between the crusher and the delivery conveyor. Then, the operation of removing the material is time consuming and cumbersome. To the contrary, in the crushing system according to the above arrangement in which a load detector is arranged on one of the operation units located downstream relative to the crusher, the load detector detects the load, if any, of the operation unit and determines if there is any crushed material remaining there or not. For instance, the operation units can be stopped after securely determining that there is no crushed material remaining on the delivery conveyor, thereby securely preventing the crushed material from remaining in the narrow space between the crusher and the delivery conveyor.

In the crushing system according to the above aspect of the present invention, the operation unit, the load of which is detected by the load detector, may preferably be the delivery conveyor arranged immediately downstream relative to the crusher.

The delivery conveyor is arranged immediately downstream relative to the crusher and a secondary conveyor, a tertiary conveyor and a grizzly may be arranged further downstream. According to the above arrangement the load of the delivery conveyor that is located immediately downstream relative to the crusher is detected and the downstream operation units including the crusher and the delivery conveyor are stopped only when the load has been cleared out or become sufficiently small. Thus, it is no longer necessary to drive the crusher etc. until the load of the secondary conveyor and/or that of the tertiary conveyor has become sufficiently small, thereby, preventing fuel and oil from being wasted.

In the crushing system according to the above aspect of the present invention, the operation unit, the load of which is detected by the load detector, may preferably be the operation unit that is arranged most downstream among the plurality of operation units.

In this crushing system according to the above arrangement, the delivery conveyor is arranged immediately downstream relative to the crusher and the secondary conveyor, the tertiary conveyor and the grizzly may be arranged further downstream. The load is detected from the operation unit arranged at the most downstream side among the operation units. With such an arrangement, no crushed material is left on any of the operation units using for the series of crushing operation steps. Thus, it is no longer necessary to remove the crushed material, if any, remaining on each of the operation units.

DETAILED DESCRIPTION OF THE PREFERRED EMBODIMENT

Now, an embodiment of the present invention will be described in greater detail by referring to the accompanying drawings.

Figure 1:
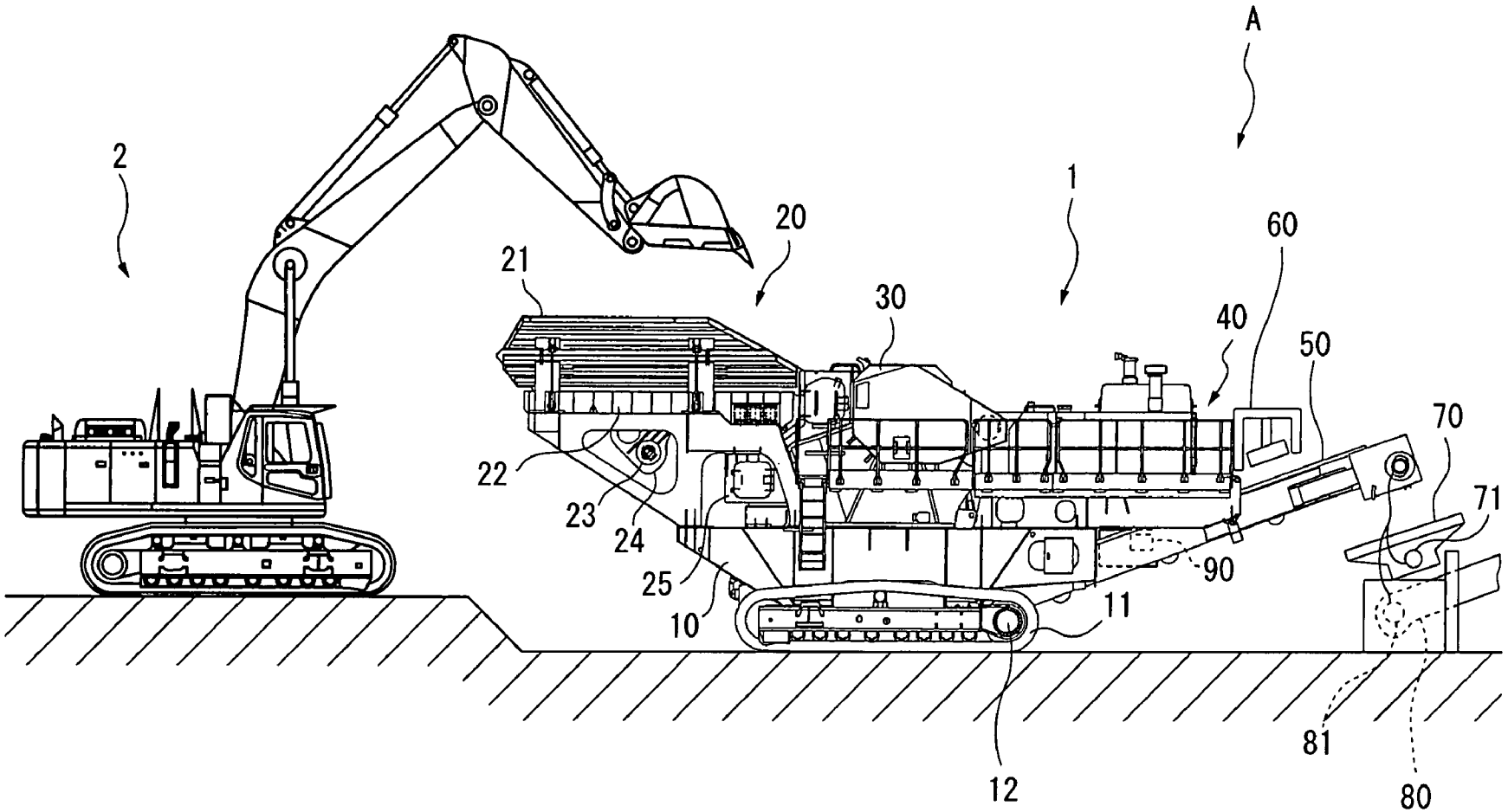
FIG. 1 is an external view showing a crushing system according to an embodiment of the invention.

FIG. 1 is an external view of a self-propelled crushing machine 1 and a loader 2 according to the embodiment of the invention. Note that the loader 2 is an ordinary power shovel and hence will not be described in greater detail here.

The self-propelled crushing machine 1 has a main body 10 provided with a pair of lower traveling bodies 11, or left and right lower traveling bodies (only one of which is shown in FIG. 1), a supplier 20 mounted at the rear side of the main body 10, a crusher (operation unit) 30 mounted at the front side of the supplier 20, a power line 40 mounted at the further front side of the crusher 30 and a delivery conveyor (operation unit) 50 extending aslant forwardly and upwardly from a lower part of the main body 10.

In the main body 10, the lower traveling bodies 11 are a crawler type driven by a hydraulic motor 12. Alternatively, the lower traveling bodies 11 may be a wheel type also driven by a hydraulic motor or a combination of the crawler type and the wheel type. The self-propelled crushing machine 1 can be moved to an optimal position by driving the lower traveling bodies 11.

The supplier 20 is provided with a hopper 21 that is upwardly broadly open to receive a raw material and a grizzly feeder 22 to transfer the received raw material to the crusher 30. The grizzly feeder 22 is driven by a hydraulic motor 24 of a vibratory equipment 23. In this embodiment, the uncrushed raw material fallen through the meshes of the grizzly feeder 22 falls to the rear side of the delivery conveyor 50 by way of the inside of a delivery chute 25 so as to be delivered to the outside with the crushed material from the crusher 30 as part of the product. A side conveyor may be arranged on the middle of the delivery chute 25 in order to deliver the uncrushed raw material separately.

In this embodiment, the crusher 30 is a jaw crusher provided with a fixed jaw and a swing jaw. However, the crusher 30 may be an impact crusher, a corn crusher, a shear crusher or a roll crusher. The swing jaw of the crusher 30 is driven by a hydraulic motor 31 (FIG. 2).

Figure 2:
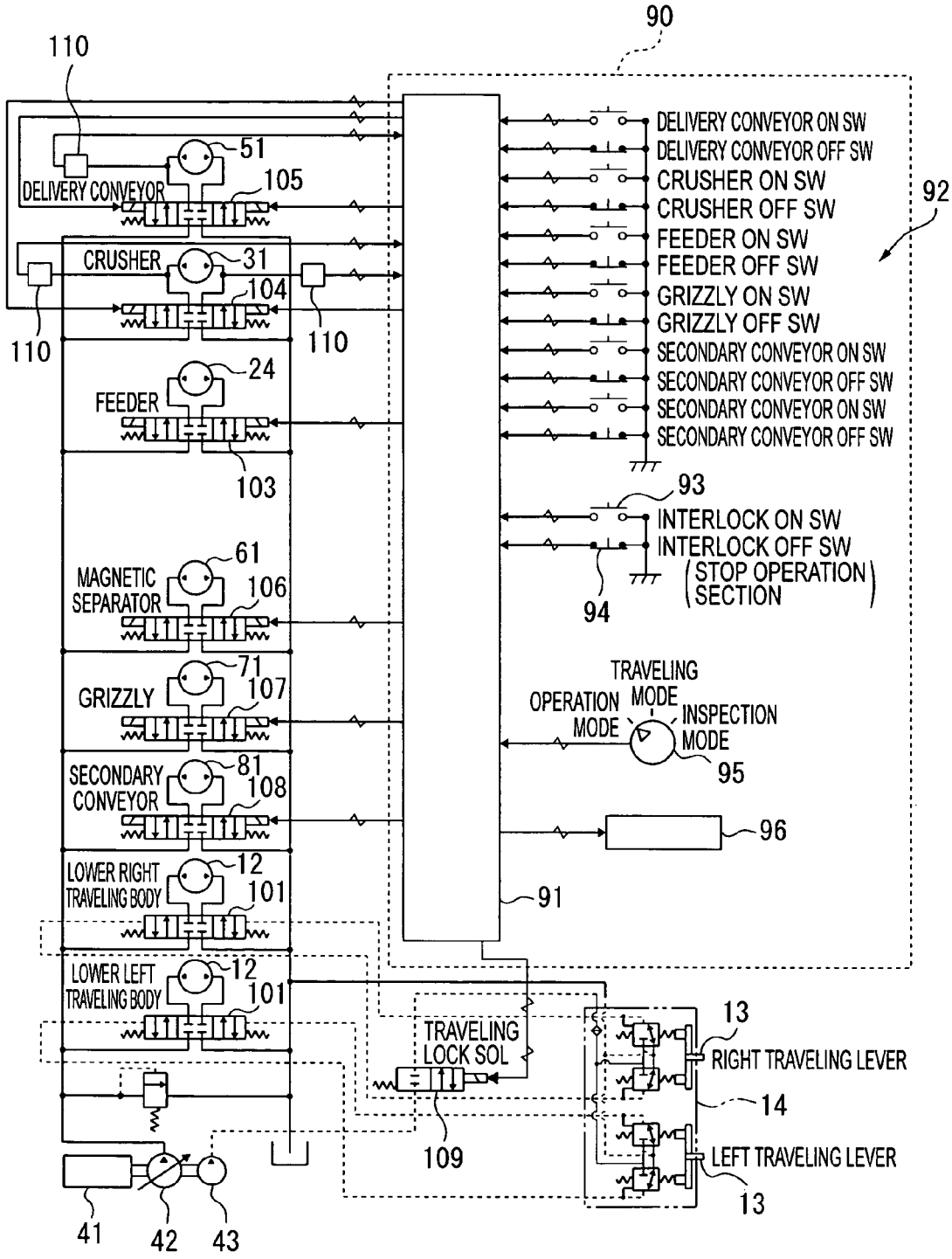
FIG. 2 is an illustration showing a hydraulic circuit and a control unit of the crushing system.

As shown in FIG. 2, the power line 40 includes an engine 41 and hydraulic pumps 42, 43 driven by the engine 41. The hydraulic pressure from the hydraulic pump 42 is supplied to the hydraulic motor 12 of the lower traveling bodies 11, to the hydraulic motor 24 of the vibratory equipment 23 arranged in the grizzly feeder 22, to the hydraulic motor 31 of the crusher 30, to a hydraulic motor 51 of the delivery conveyor 50 described below, to a hydraulic motor 61 of a magnetic separator 60, to a hydraulic motor 71 of a grizzly (operation unit) 70 and to a hydraulic motor 81 of a secondary conveyor (operation unit) 80 by way of control valves 101 through 108. The hydraulic pressure from the hydraulic pump 43 is supplied to the traveling lock control valve 109 and, when the traveling lock is unlocked, also to the control valve 101 as pilot pressure by way of a direction switch machine 14 arranged in the left and right traveling levers 13.

The delivery conveyor 50 conveys the crushed material crushed by the crusher 30 to the front side of the crushing system and piles the material on the ground. As pointed out earlier, the delivery conveyor 50 is driven by the front end hydraulic motor 51. Note that the embodiment is provided with the magnetic separator 60 for removing a reinforcing steel from the crushed material on the delivery conveyor 50 on an assumption that concrete blocks containing the reinforcing steel etc. may be supplied as the raw material. Also note that the crushed material discharged from the delivery conveyor 50 is not simply piled on the ground but after being sorted in terms of grain size by the grizzly 70. The crushed material having small grain sizes that falls through the meshes of the grizzly 70 are moved out to an isolated location by the secondary conveyor 80, whereas the crushed material having large grain sizes that are left on the grizzly 70 either falls, sliding down, from the grimy 70 and piles or is moved out to a specific location by a tertiary conveyor (not shown). The grizzly 70, the secondary conveyor 80 and the self-propelled crushing machine 1 form the crushing system A according to the present invention.

Figure 9:
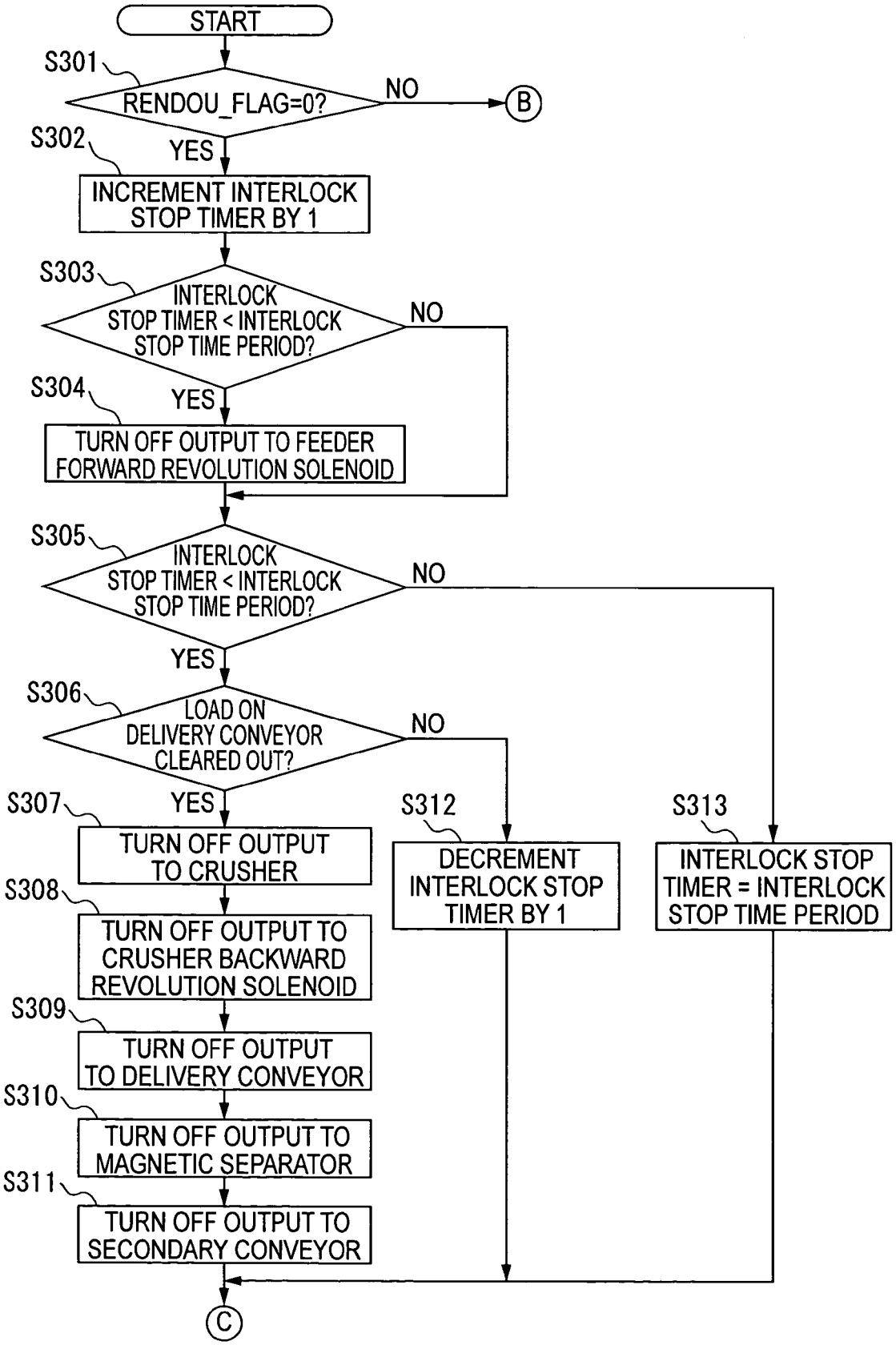
FIG. 9 is a flow chart illustrating a processing operation of stopping an interlocked operation in an operation mode.

As seen from FIGS. 1 and 2, the self-propelled crushing machine 1 further has a control unit 90 arranged at the front side of the main body 10. In FIG. 9, the control unit 90 includes a group of ON-OFF switches (SWs) 92 for the above described operation units, more specifically respective ON-OFF switches 92 for the grizzly feeder 22, the crusher 30, the delivery conveyor 50, the magnetic separator 60, the grizzly 70 and the secondary conveyor 80 as well as an interlock ON switch 93 for driving the operation units to start operating in a predetermined order in an interlocked manner, an interlock OFF switch (operation stop section) 94 for stopping the operation units in the interlocked manner, and a mode selection switch 95 for selecting an operation mode, a traveling mode or an inspection mode as mode of operation of the crushing system A. The signals from the switches 92 through 95 are input to a controller 91. The crushing system A performs ordinary crushing operations in the operation mode. The lower traveling bodies 11 are driven to move the crushing system A in the traveling mode. The outlet port of the crusher 30 is regulated or the crusher 30 is manually inched for an inspection in the inspection mode.

Figure 3:
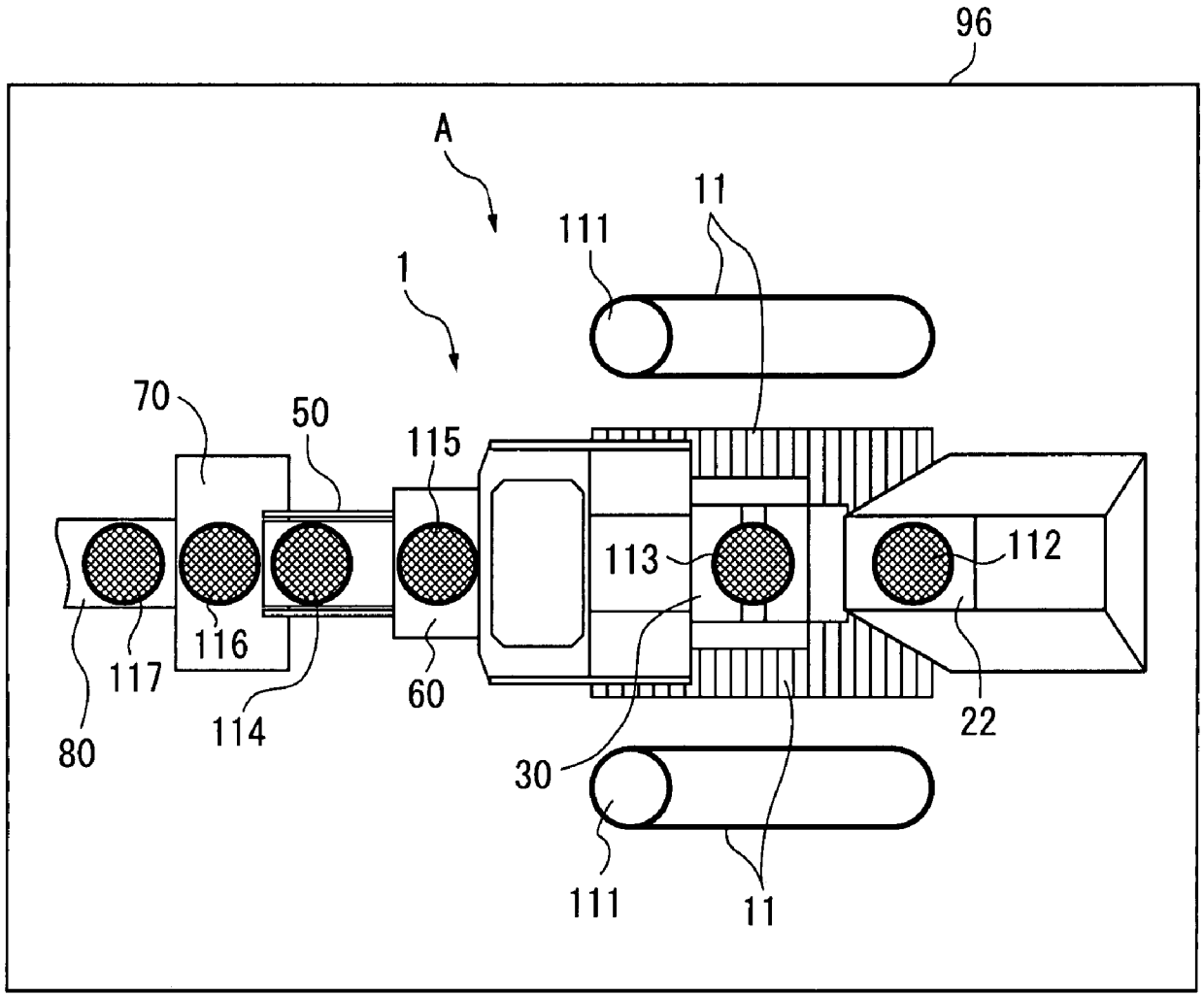
FIG. 3 is an illustration showing a display screen of a vehicle monitor arranged on the crushing system.

The control unit 90 has a vehicle monitor 96. The vehicle monitor 96 typically includes a liquid crystal display and is connected to a ten-key block (not shown) of the control unit 90. The vehicle monitor 96 normally shows a schematic plan view of the crushing system A as shown in FIG. 3. The operation units 22, 30, 50, 60, 70 and 80 of the crushing system A are graphically illustrated in the plan view. The left and right lower traveling bodies 11 that are partly hidden by the grimy feeder 22, the crusher 30, the power line 40 and so on in the plan view of the crushing system A are separately shown in an elevational view above and below the plan view of the crushing system A. These views can be drawn in a desired manner by a related computer software.

In the plan view of the crushing system A, the operation status of each of the operation units 11, 22, 30, 50, 60, 70 and 80 is graphically shown in the corresponding circular display section 111, 112, 113, 114, 115, 116 or 117. When the operation units 11, 22, 30, 50, 60, 70 and 80 are operating properly, the display sections 111 through 117 are lighted in green in this embodiment. (Note that the display sections 111 through 117 are shaded in FIG. 3 to indicate that they are lighted in green.) When the operation units 11, 22, 30, 50, 60, 70 and 80 operate properly but are at rest at present, they are lighted in white. In the operation mode where at least one of the operation units 22, 30, 50, 60, 70 and 80 is operating, the left and right lower traveling bodies 11 are at rest and prohibited from being driven to move. Therefore, the display sections 111 of the lower traveling bodies 11 are lighted in white to show that they are at rest in FIG. 3. When, on the other hand, the traveling mode is selected and the crushing system A is moving, the graphic display sections 111 of the lower traveling bodies 11 are lighted in green to indicate that the crushing system A is traveling. Under this condition, the display sections 112 through 117 of all the other operation units 22, 30, 50, 60, 70 and 80 are lighted in white to indicate that those operation units are at rest.

Incidentally that any of the display sections 111 through 117 can be used with colors corresponding to the current operating status of the crusher 30 or the delivery conveyor 50. For example, when the crusher 30 or the delivery conveyor 50 is in an abnormal state, the corresponding display section may be lighted in red and when the hydraulic motor 12 or 31 of the lower traveling bodies 11 or the crusher 30, whichever appropriate, is driven in reverse, the corresponding display section may be lighted in yellow. There may be various techniques that can be used to determine if the crusher 30 and/or the delivery conveyor 50 is in an abnormal state or not. For example, the pressure value obtained by the load detector 110, which will be described in greater detail hereinafter, may be compared with a predetermined abnormal pressure level to be determined to be in an abnormal state when the pressure value that exceeds the abnormal pressure level is input continuously for a predetermined time period, so that the operation unit on which the abnormal pressure value is detected can be determined as abnormal.

Of the above described control unit 90, the controller 91 receives signals from the switches 92 through 95 and respectively outputs a control signal for the operation units 22, 30, 50, 60, 70 and 80 to the control valves 103 through 109 (so as to turn the output of any of the solenoids ON or OFF), so that the operation status of any the operation units needs to be switched. Note that, in a state where at least one of the operation units 22, 30, 50, 60, 70 and 80 is driven to operate (in a mode other than the traveling mode), the controller 91 turns OFF the solenoid output of the traveling lock control valve 109 to block the pilot pressure for switching the control valves 101 of the lower traveling bodies 11 and thereby preventing the lower traveling bodies 11 from moving. On the other hand, load detectors 110 such as pressure sensors are arranged respectively on the hydraulic circuits of the hydraulic motors 31, 51 of the crusher 30 and the delivery conveyor 50 at the inlet sides thereof and the pressure values of the hydraulic circuits are input from the load detectors 110 to the controller 91 as pressure signals. Another load detector 110 is arranged on the hydraulic circuit of the hydraulic motor 31 of the crusher 30 at the return side thereof in addition to the load detector 110 at the inlet side so that the pressure value of the hydraulic motor 31 can be detected in operation regardless if it is driven forward or backward.

Figure 4:
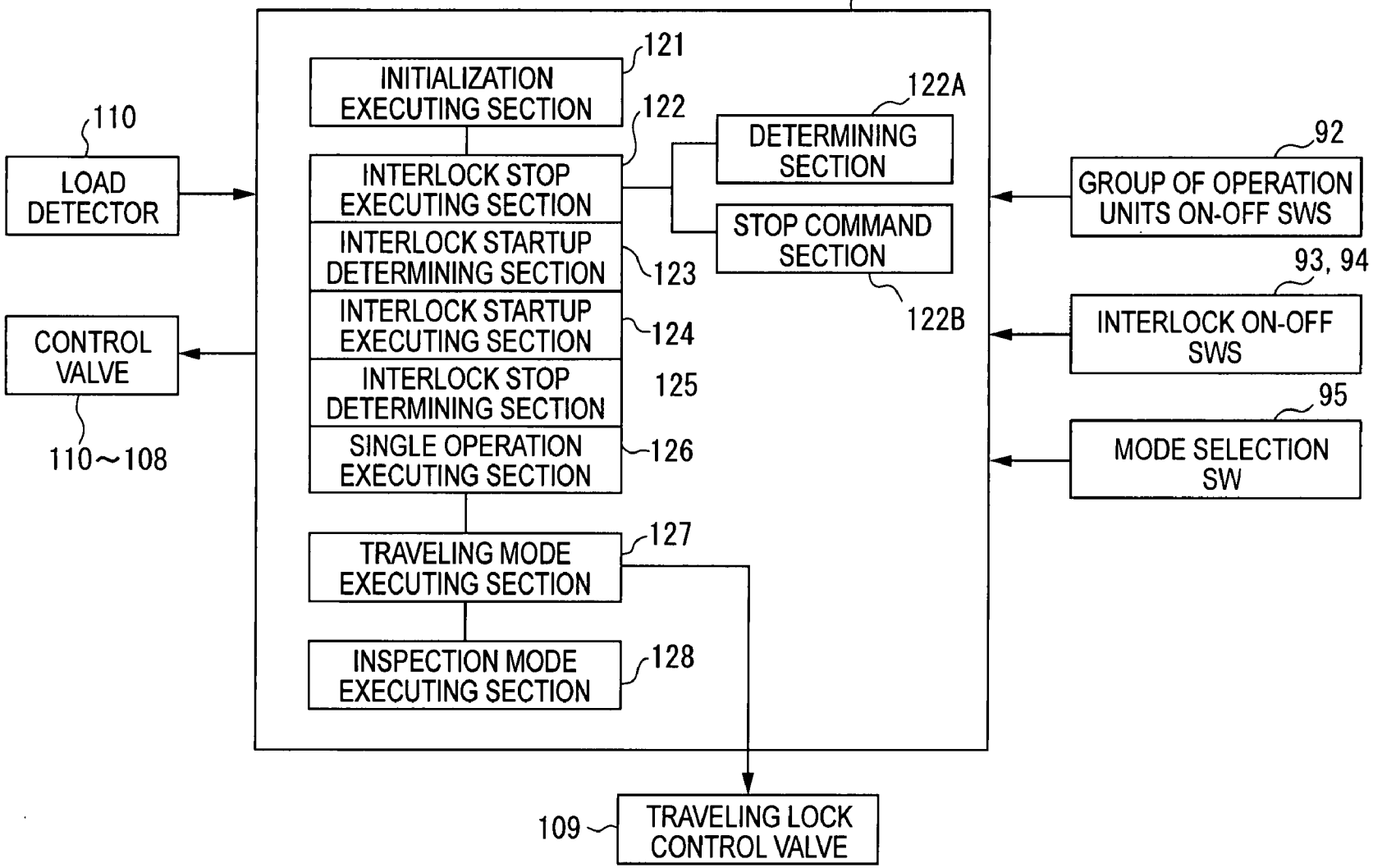
FIG. 4 is a block diagram illustrating a computer program executed in the controller.

As shown in the block diagram of FIG. 4, the controller 91 is provided with an initialization executing section 121, an interlock stop executing section 122, an interlock startup determining section 123, an interlock startup executing section 124, an interlock stop determining section 125, a single operation executing section 126, a traveling mode executing section 127 and an inspection mode executing section 128 that are realized by software such as a computer program as well as a memory section (not shown) for storing the software and the detected pressure values as data.

The initialization executing section 121 is in fact a computer program for executing a processing operation of initialization of Step (to be denoted by "S" in the related drawings and in the following description) 100 in the flow chart of FIG. 5. When the engine 41 is started and the controller 91 is activated, the initialization executing section 121 firstly executes an initialization process.

Each of the sections from the interlock stop executing section 122 to the single operation executing section 126 executes an operation mode process in S300 when the operation mode is selected by the mode selection switch 95 and it is determined in S200 that the operation mode is selected. When an interlock stop is executed in the operation mode process, the determining section 122A and the stop command section 122B of the interlock stop executing section 122 start operating to detect the load of the delivery conveyor 50 by the load detector 110 and stops the operation units 50, 60, 70 and 80 located downstream relative to the crusher 30 when no load is detected by the load detector 110.

The traveling mode executing section 127 executes a traveling mode process of S500 when the traveling mode is selected by the selection switch 95 and it is determined in S400 that the traveling mode is selected.

The inspection mode executing section 128 executes an inspection mode process of S600 when the inspection mode is selected by the selection switch 95 and it is determined in S200 and S400 that neither the operation mode nor the traveling mode is selected.

The processes S100, S300, S500 and S600 will be described below in greater detail.

Figure 6:
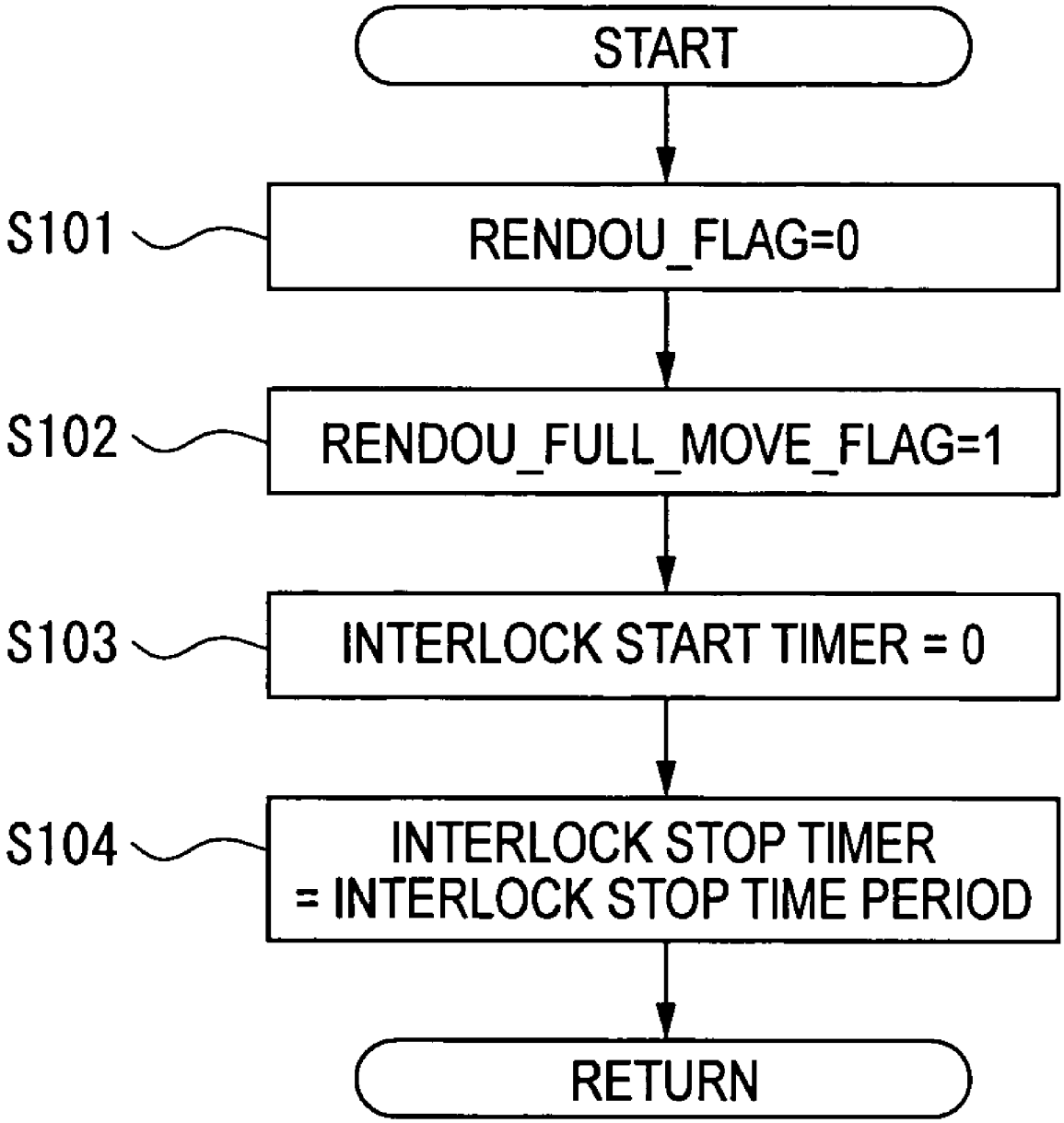
FIG. 6 is a flow chart showing an initialization process.

Firstly, the initialization process will be described by referring to the flow chart of FIG. 6.

Figure 7:
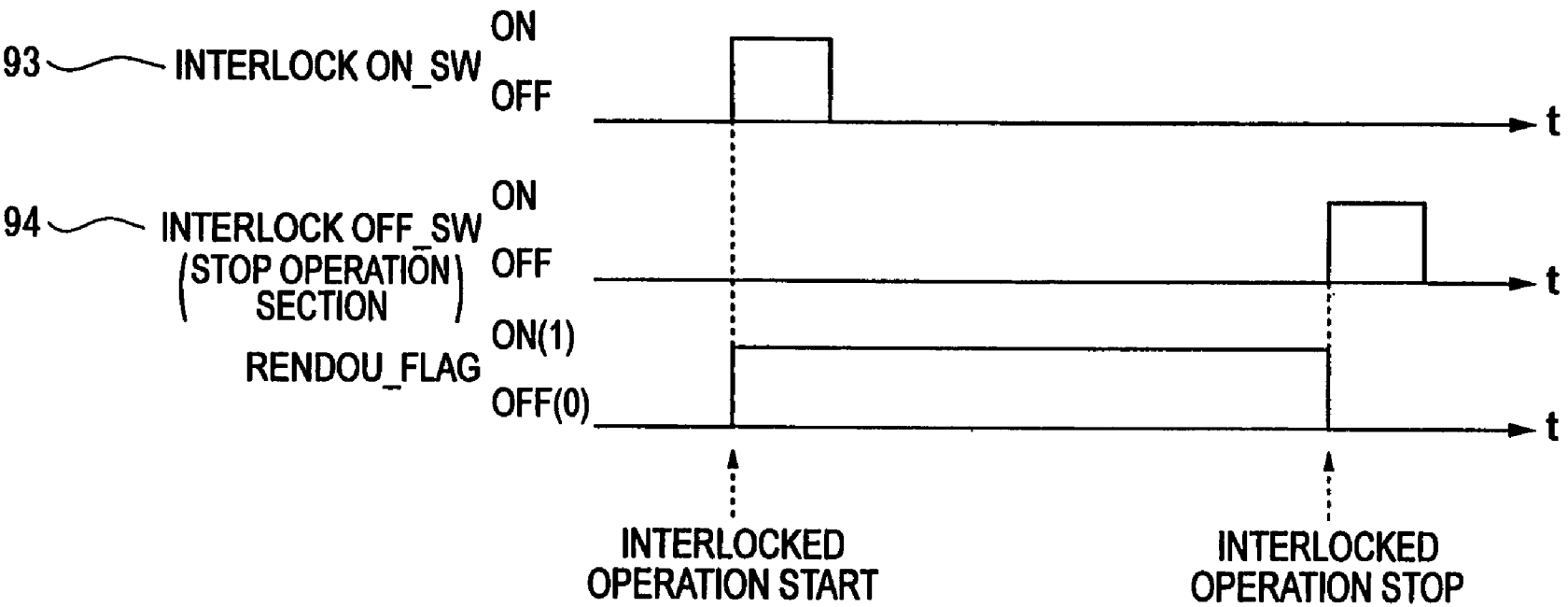
FIG. 7 Prior Art
FIG. 7 is a timing chart illustrating RBNDOU_FLAG.

In S101 of the initialization process, as the crushing system A is started and the controller 91 is activated, RENDOU_FLAG=0 is set. The RENDOU_FLAG is a flag to be used for determining if the crushing system A is in an interlocked operation or not. The crushing system A is in the interlocked operation when the RENDOU_FLAG is equal to "1", whereas the crushing system A is operating in a mode other than the interlocked operation mode when the RENDOU_FLAG is equal to "0". As shown in the flow chart of FIG. 7, the RENDOU_FLAG becomes equal to "1" when the interlock ON switch 93 is turned ON, whereas it becomes equal to "0" when the interlock OFF switch 94 is turned ON.

In S102, RENDOU_FULL_MOVE_FLAG=1 is set. The RENDOU_FULL_MOVE_FLAG is a flag to be used to indicate if the operation units 22, 30, 50, 60, 70 and 80 have all been started by an interlock start operation or not. All the above operation units have been started when the RENDOU_FULL_MOVE_FLAG is equal to "1", whereas they have not been started when the RENDOU_FULL_MOVE_FLAG is equal to "0".

In S103, the interlock start timer is cleared so as to show 0. In this embodiment when the interlock ON switch 93 is turned ON to make the RENDOU_FLAG equal to "1", the secondary conveyor 80, the grizzly 70, the magnetic separator 60, the delivery conveyor 50 and the crusher 30 are sequentially started from the downstream side before the grizzly feeder 22 is finally started and the interlock start timer clocks a startup time of the respective operation units. The timer of the embodiment is a so-called counter and the reading of the timer (counter) is incremented, decremented, cleared to zero or set to a predetermined value each time when a cycle of operation shown in the flow chart of FIG. 5 is completed with a predetermined cycle period. Therefore, the elapsed time of the operation can be arithmetically determined on the basis of the reading of the timer when a substantially constant value is selected for the execution time of each cycle of operation.

In S104, the interlock stop timer is set as equal to the interlock stop time period. The interlock stop time period has a predetermined value.

The above-described initialization process is executed by the initialization executing section 121.

Figure 8:
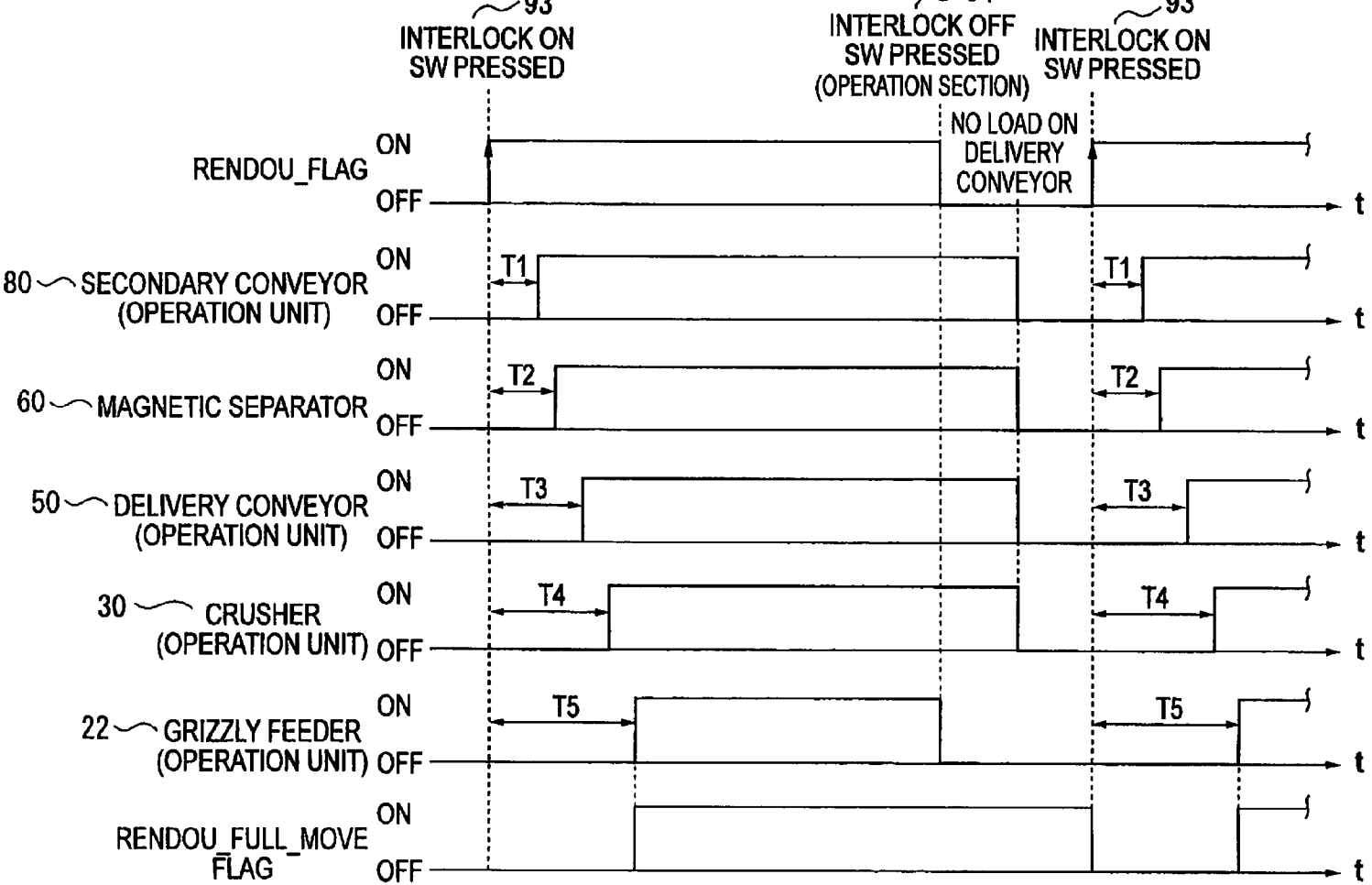
FIG. 8 Prior Art
FIG. 8 is a timing chart illustrating RENDOU_FULL_MOVE_FLAG.

FIG. 8 is a timing chart illustrating the basic mutual relationship of the RENDOU_FLAG, the RENDOU_FULL MOVE_FLAG and the operation units 22, 30, 50, 60 and 80. Since the relationship relative to the grizzly 70 can be easily understood by seeing its relationship with the above listed operation units 22, 30, 50, 60 and 80, the explanation and the illustration of the grizzly 70 is omitted in FIG. 8. Nor is it described any further in the explanation of the interlock mode process.

As shown in FIG. 8, as the interlock ON switch 93 is pressed in an operation mode for example, the RENDOU_FLAG becomes ON and is set to "1". When a secondary conveyor startup time T1 (practically T1=0 is acceptable) has elapsed since the setting of "1", the secondary conveyor 80 starts operating. When a magnetic separator statup time T2 has elapsed since the setting of "1", the magnetic separator 60 starts operating. Similarly, when a delivery conveyor startup time T3 has elapsed since the setting of "1", the delivery conveyor 50 starts operating. When a crusher startup time T4 has elapsed since the setting of "1", the crusher 30 starts operating. Finally, when a grizzly feeder startup time T5 has elapsed since the setting of "1", the grizzly feeder 22 starts operating. The RENDOU_FULL_MOVE_FLAG becomes ON and is set to "1" simultaneously with the startup of the grizzly feeder 22.

In this embodiment, any of the group of ON-OFF switches 92 shown in FIG. 2 can be operated when the RENDOU_FLAG=0 (OFF) or the RENDOU_FULL_MOVE_FLAG=1 (ON). Then, one of the operation units 22, 30, 50, 60, 80 can be operated alone. In other words, during the time period from the time when the interlock ON switch 93 is pressed to the time when the RENDOU_FULL_MOVE_FLAG becomes ON, any of the operation units 22, 30, 50, 60 and 80 cannot be operated alone so that the grizzly feeder 22 cannot be operated before the delivery conveyor 50 and the crusher 30 start operating and hence clogging of the crushed material is prevented from occurring. The time lag between the crusher startup time T4 and the grizzly feeder startup time T5 is reliably secured so that the raw material may be supplied by the grizzy feeder 22 and the crushing operation is started smoothly only after a reliable start of the operation of the crusher 30 with large inertia force.

Referring again to FIG. 8, when the interlock OFF switch 94 is pressed, on the other hand, firstly the grizzly feeder 22 stops and thereafter, when it is determined that the load of the delivery conveyor 50 is cleared and hence the crushed material on the delivery conveyor 50 has completely been discharged, the crusher 30, the delivery conveyor 50, the magnetic separator 60, the grizzly 70 and the secondary conveyor 80 stop substantially simultaneously. Then, the state where the RENDOU_FULL_MOVE_FLAG is ON is maintained until the interlock ON switch 93 is pressed once again. As will be described in greater detail hereinafter, this process characterizes this embodiment most.

Now, the process in the operation mode in S300 (FIG. 5) will be described by referring to FIGS. 7 through 14. The process in the operation mode is divided into respective flows of: interlock stop operation, an interlock start determination, an ininterlock-period operation, an interlock flag OFF determination and a single operation. The flows of the operations are repeated cyclically within a processing time of about 0.01 seconds. Each of the flows of operation will be discussed below.

FIG. 9 shows a flow chart of the interlock stop operation in the operation mode process. This operation is performed by the interlock stop executing section 122.

In S301 in FIG. 9, it is determined if the RENDOU_FLAG is equal to "0" or not. When the RENDOU_FLAG is equal to "1", the interlocked operation is still continuing so that the processing operation proceeds to S320. When the RENDOU_FLAG is equal to "0", the interlocked operation has been stopped so that the processing operation proceeds to S302. The RENDOU_FLAG is set to "0" in the S101 immediately after the crushing system A is started and the power supply to the controller 91 is turned ON, so that, if the crushing system A is currently in such a situation, processing operation proceeds to the S302.

In the S302, the reading of the interlock stop timer is incremented by 1 each time when each of the operation units 22, 30, 50, 60 and 80 is stopped from the upstream side to stop the interlocked operation (in practice, the operation units 30, 50, 60 and 80 are stopped substantially simultaneously).

In S303, it is determined if the reading of the interlock stop timer is smaller than the interlock stop time period or not. If the reading of the interlock stop timer is smaller than the interlock stop time period, the processing operation proceeds to S304 and the output to the solenoid of the control valve 102 is turned OFF to stop the grizzly feeder 22. If, on the other hand, the reading of the interlock stop timer has reached to the interlock stop time period, the processing operation proceeds to S305 because the interlock stop timer is currently set as equal to the interlock stop time period in the S104 (FIG. 6) and the reading of the interlock stop timer is incremented by 1 in the S302.

In the S305, it is determined if the reading of the interlock stop timer is equal to the interlock stop time period or not If the reading of the interlock stop timer has become equal to the interlock stop time period, the processing operation proceeds to S306, where it is determined if the load of the delivery conveyor 50 has been cleared on the basis of the detected outcome of the detecting operation of the load detector 110 (i.e., if no crushed material is on the delivery conveyor 50 or not). This load determining operation is typically performed by the determining section 122A of the interlock stop executing section 122 (FIG. 4) on the basis if the pressure value detected by the load detector 110 has reached to the predetermined pressure value that correspond to a non-load state or not. This load determining operation will be described more specifically hereinafter by referring to FIGS. 17 through 19.

If it is determined that the delivery conveyor 50 has been cleared of the load, the processing operation proceeds to S307 through 311, where all the outputs to the forward revolution solenoid and the backward revolution solenoid for the crusher 30, the forward revolution solenoid for the delivery conveyor 50, the forward revolution solenoid for the magnetic separator 60, the forward revolution solenoid for the grizzly 70 and the forward revolution solenoid for the secondary conveyor 80 are turned OFF to stop the above listed operation units. The OFF outputs for stopping the operation units (stop command signal) are made by the stop command section 122B of the interlock stop executing section 122 (FIG. 4).

When the load of the delivery conveyor 50 is not sufficiently small, it is determined that the crushed material is still remaining on the delivery conveyor 50 and the processing operation proceeds to S312 where the reading of the interlock stop timer is decremented by 1 and the operation units 30, 50, 60 and 80 are continuously driven to operate until the load on the delivery conveyor 50 is cleared out.

If, on the other hand, the reading of the interlock stop timer is greater than the interlock stop time period in the S305, the processing operation proceeds to S313, where the interlock stop timer is set to the interlock stop time period and subsequently the processing operation proceeds to S314 in FIG. 10. In the current status immediately after starting the operation of the crushing system A, the processing operation proceeds to the S314.

Figure 10:
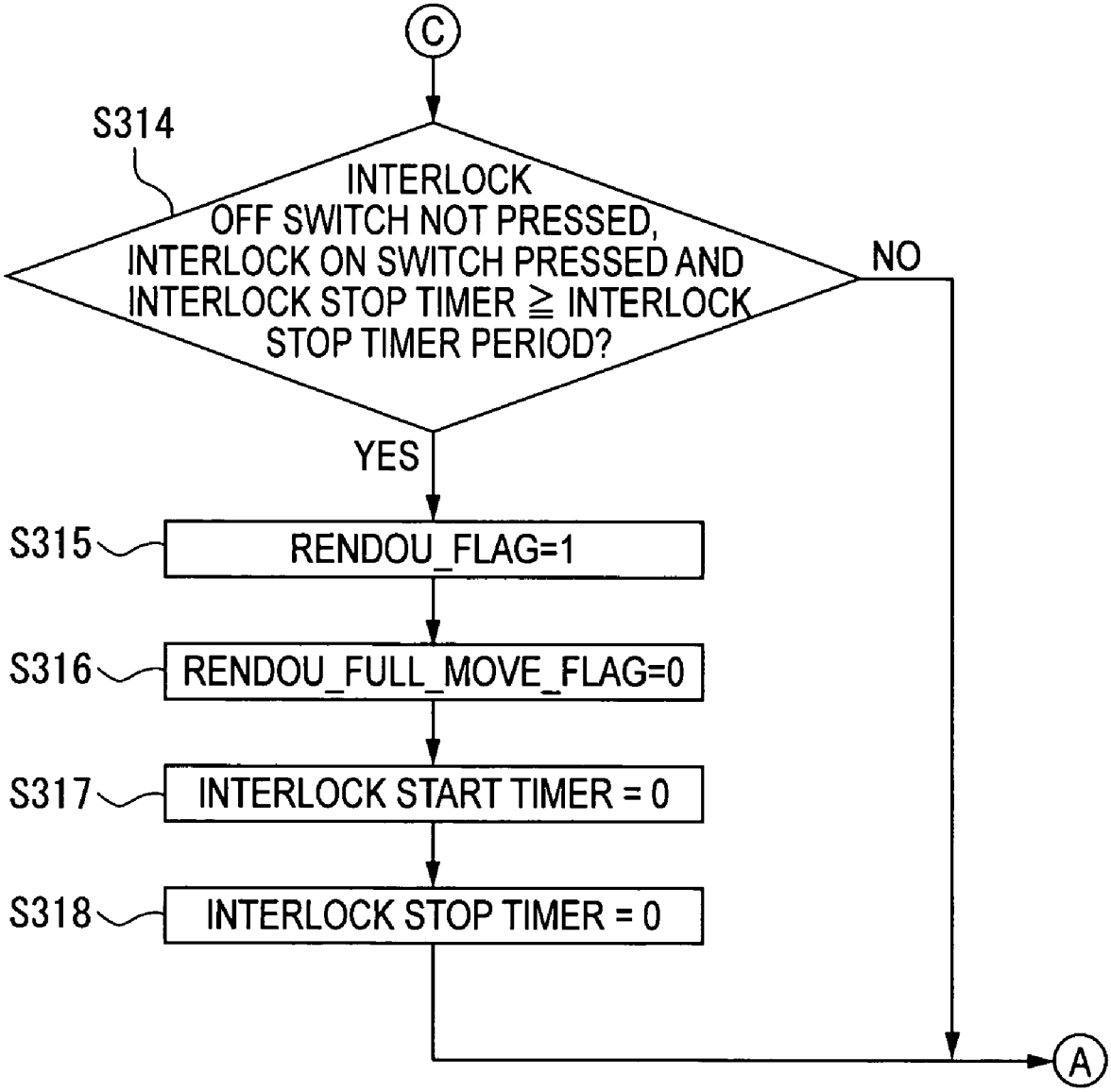
FIG. 10 is a flow chart illustrating a processing operation of determining the start of an interlocked operation in the operation mode.

FIG. 10 shows a flow chart for the operation of determining if an interlocked operation has been started in the operation mode or not. This operation is performed by the interlock startup determining section 123.

In the S314 of FIG. 10, the processing operation of determining if an interlocked operation has been started or not is conducted. If the interlock OFF switch 94 has not pressed but the interlock ON switch 93 has been pressed and the reading of the interlock stop timer has exceeded to the interlock stop time period, the processing operation proceeds to S315, where the RENDOU_FLAG is set to "1", then to S316, where the RENDOU_FULL_MOVE_FLAG is set to "0" (a state where not all the operation units have completed the respective operations), then to S317, where the interlock start timer is cleared to nil, and then to S318, where the interlock stop timer is also cleared to nil. If, on the other hand, it is determined in the S314 that the requirements are not met, the processing operation proceeds to S360 shown in FIG. 15 by way of "A" and "G" in FIG. 14 to follow the flow of the single operation. Since the interlock ON switch 93 is not currently pressed, the processing operation proceeds from the S314 to the S360. If the single operation is not performed in the S360 and the following steps, the processing operation passes through 'T' in FIG. 15 and goes to S381, where the travel lock solenoid is turned OFF. Subsequently, the processing operation returns to the S200 in FIG. 5 and the steps starting from the S301 is repeated when the crushing system A is still in the operation mode.

Now, an instance where the crushing system A is started (the power supply of the controller 91 is turned ON) and the interlock ON switch is turned ON to start the interlocked operation while the above steps are being repeated will be discussed below. Since "1" is set for the RENDOU_FLAG in such a situation, the processing operation proceeds from the S301 in FIG. 9 to the S320 shown in FIG. 11.

Figure 11:
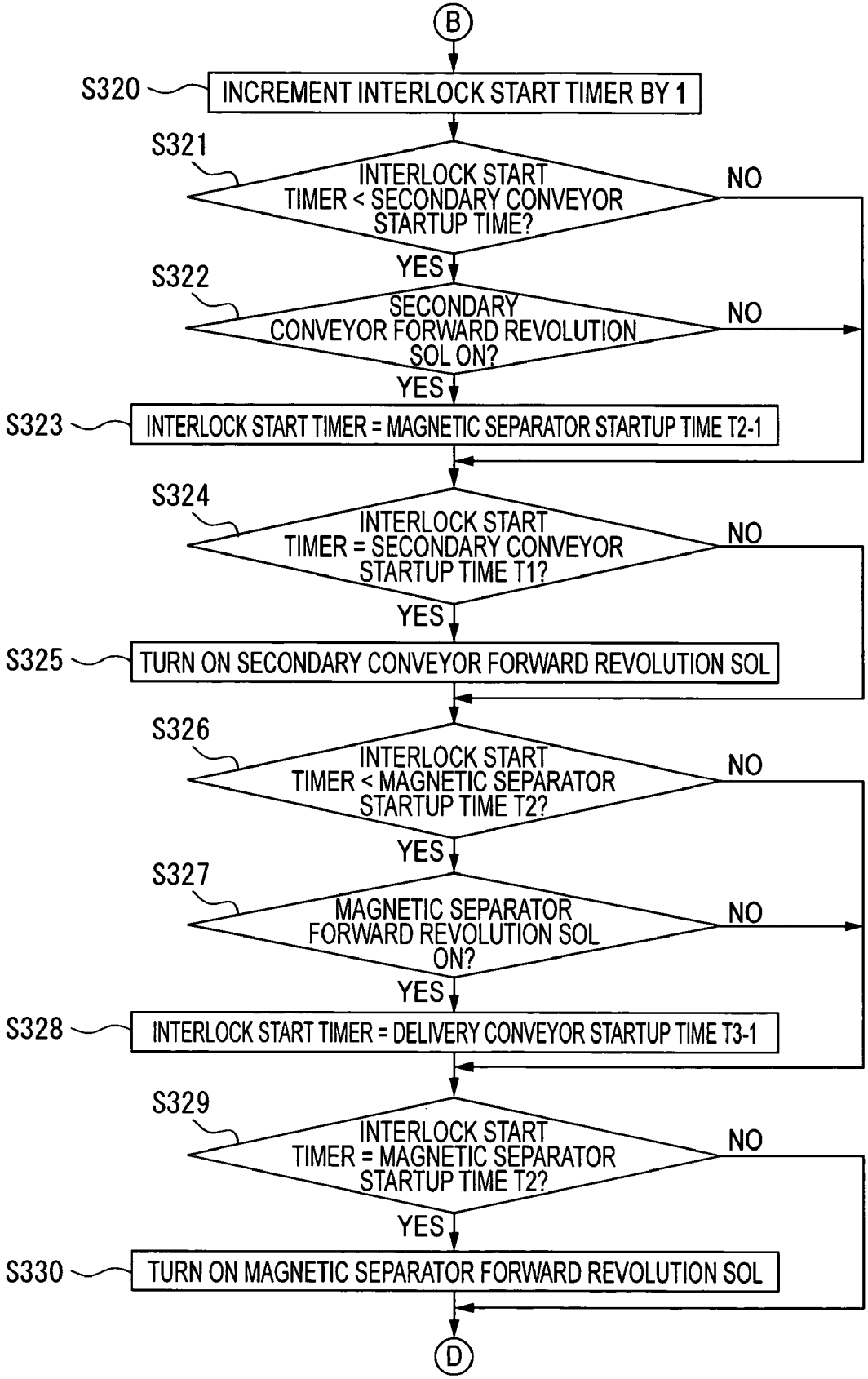
FIG. 11 is a flow chart illustrating a processing operation while the interlocked operation is starting in the operation mode.
Figure 12:
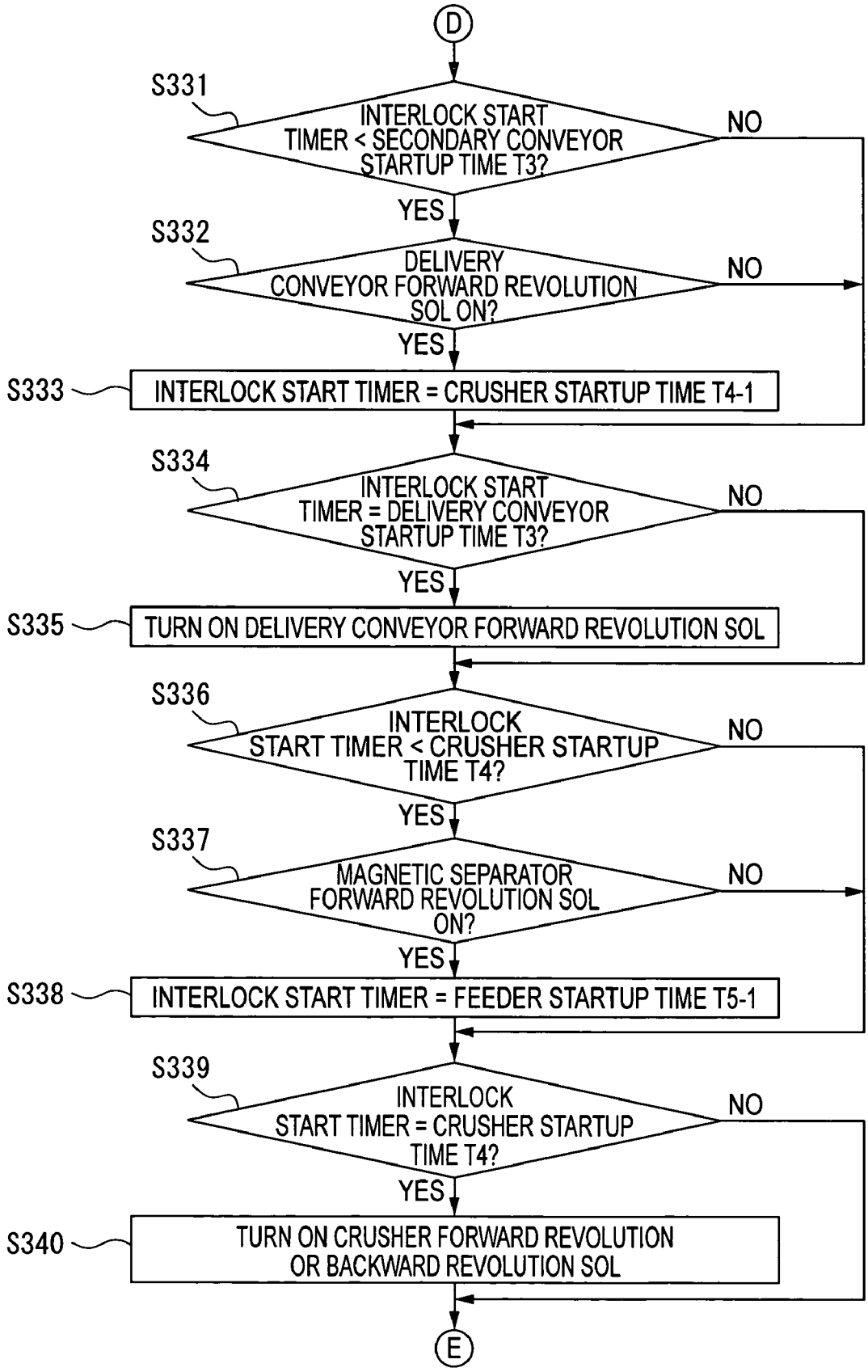
FIG. 12 is a flow chart immediately succeeding the processing operation while the interlocked operation is starting in FIG. 11.
Figure 13:
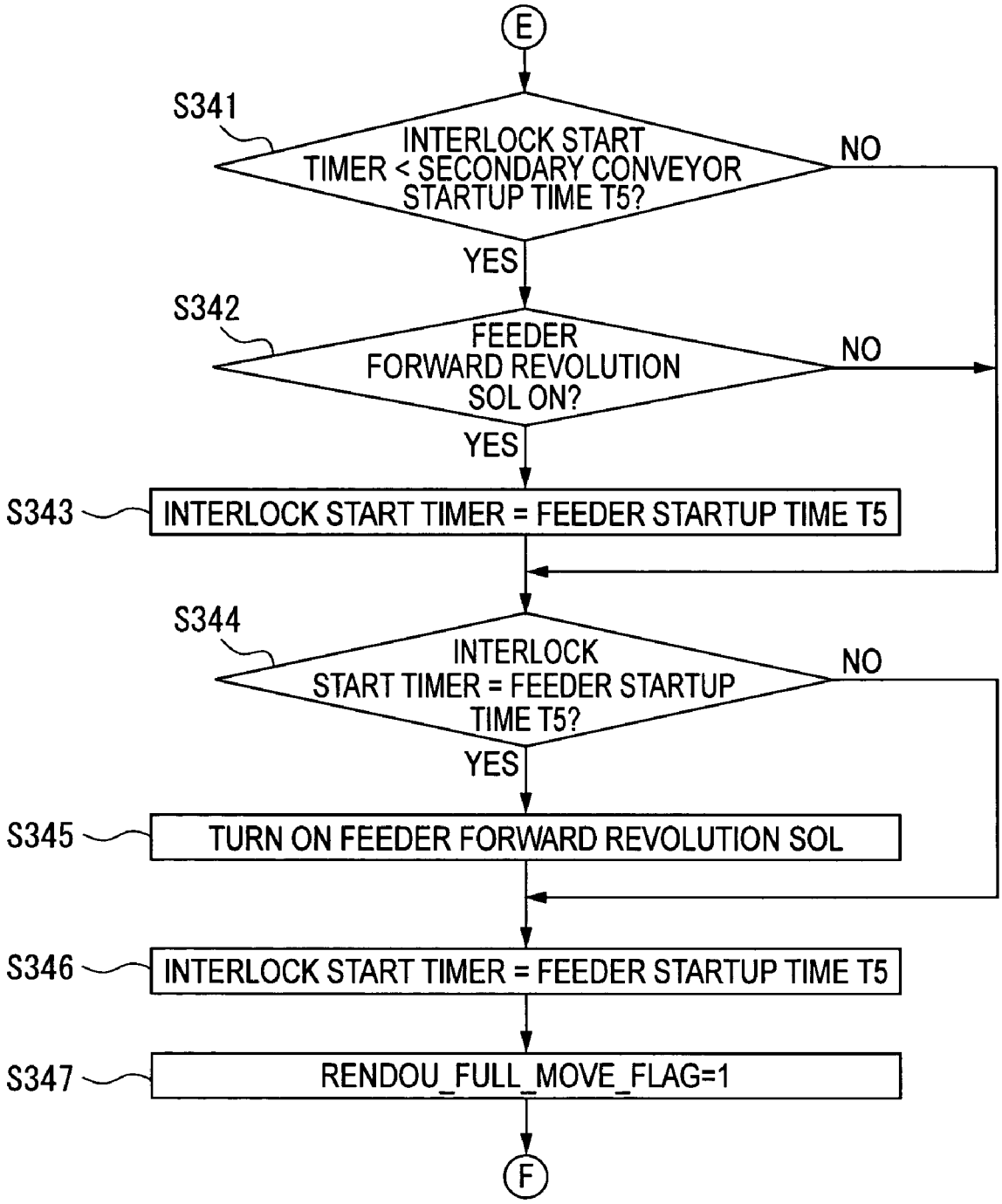
FIG. 13 is a flow chart immediately succeeding the processing operation while the interlocked operation is starting in FIG. 12.

FIG. 11 shows a flow chart for an interlocked operation that is started in the operation mode. This operation is performed by the interlock startup executing section 124.

Referring to the S320 in FIG. 11, the interlock start timer is incremented by 1 and the processing operation proceeds to the S321. In the steps starting from S321, the downstream operation units are sequentially started in the order beginning with the secondary conveyor 80, the magnetic separator 60, the delivery conveyor 50, the crusher 30 and then the grizzly feeder 22 (the grizzly 70 is not described here). The startup time periods of the operation units are listed in order of increasing; the secondary conveyor startup time T1, the magnetic separator startup time T2, the delivery conveyor startup time T3, the crusher startup time T4 and grizzly feeder startup time T5 as shown in FIG. 8.

To follow the above starting order, firstly it is determined in the S321 if the reading of the interlock start timer is smaller than the secondary conveyor startup time T1 or not. If the answer to this question is YES, the processing operation proceeds to S322, where it is determined if the secondary conveyor 80 has been started (e.g., for single operation) or not. If it is determined that the secondary conveyor 80 has been started, the processing operation proceeds to S323, where the reading of the interlock start timer is made smaller than the value of the magnetic separator startup time T2 by 1, and then to S324. If, on the other hand, it is determined in the S322 that the secondary conveyor 80 has not been started, the processing operation skips the S323 and proceeds to S324. If the answer to the above question is NO in the S321, the processing operation skips the S322 and the S323 and proceeds to the S324.

Then, in the S324, it is determined if the reading of the interlock start timer is equal to the secondary conveyor startup time T1 or not. If the answer to this question is YES, the processing operation proceeds to S325, where the forward revolution solenoid for the secondary conveyor 80 is turned ON, and then to the S326.

In the S326, it is determined if the reading of the interlock start timer is smaller than the magnetic separator startup time T2 or not. If the answer to this question is YES, the processing operation proceeds to S327, where it is determined if the magnetic separator 60 has been started (e.g., for single operation) or not. If it is determined that the magnetic separator 60 has been started, the processing operation proceeds to S328, where the reading of the interlock start timer is made smaller than the value of the delivery conveyor startup time T3 by 1, and then to S329. If, on the other hand, it is determined in the S327 that the magnetic separator 60 has not been started, the processing operation skips the S328 and proceeds to the S329. If the answer to the above question is NO in the S326, the processing operation skips the S327 and the S328 and proceeds to the S329.

Then, in the S329, it is determined if the reading of the interlock start timer is equal to the magnetic separator startup time T2 or not. If the answer to this question is YES, the processing operation proceeds to S330, where the forward revolution solenoid for the magnetic separator 60 is turned ON, and then to S331.

In the S331, it is determined if the reading of the interlock start timer is smaller than the delivery conveyor startup time T3 or not. If the answer to this question is YES, the processing operation proceeds to S332, where it is determined if the delivery conveyor 50 has been started (e.g., for single operation) or not. If it is determined that the delivery conveyor 50 has been started, the processing operation proceeds to S333, where the reading of the interlock start timer is made smaller than the value of the crusher startup time T4 by 1, and then to S334. If, on the other hand, it is determined in the S332 that the delivery conveyor 50 has not been started, the processing operation skips the S333 and proceeds to S334. If the answer to the above question is NO in the S331, the processing operation skips the S332 and the S333 and proceeds to the S334.

Then, in the S334, it is determined if the reading of the interlock start timer is equal to the delivery conveyor startup time T3 or not. If the answer to this question is YES, the processing operation proceeds to S335, where the forward revolution solenoid for the delivery conveyor 50 is turned ON, and then to S336.

In the S336, it is determined if the reading of the interlock start timer is smaller than the crusher startup time T4 or not. If the answer to this question is YES, the processing operation proceeds to S337, where it is determined that if the crusher 30 has been started (e.g., for single operation) or not. If it is determined that the crusher 30 has been started, the processing operation proceeds to S338, where the reading of the interlock start timer is made smaller than the value of the grizzly feeder startup time T5 by 1, and then to S339. If, on the other hand, it is determined in the S337 that the crusher 30 has not been started, the processing operation skips S338 and proceeds to the S339. If the answer to the above question is NO in the S336, the processing operation skips the S337 and the S338 and proceeds to the S339.

Then, in the S339, it is determined if the reading of the interlock start timer is equal to the crusher startup time T4 or not. If the answer to this question is YES, the processing operation proceeds to S340, where the forward revolution solenoid for the crusher 30 is turned ON, and then to S341 shown in FIG. 13.

In the S341, it is determined if the reading of the interlock start timer is smaller than the grizzly feeder startup time T5 or not. If the answer to this question is YES, the processing operation proceeds to S342, where it is determined if the grizzly feeder 22 has been started (e.g., for single operation) or not. If it is determined that the grizzly feeder 22 has been started, the processing operation proceeds to S343, where the reading of the interlock start timer is made equal to the value of the grizzly feeder startup time T5, and then to S344. If, on the other hand, it is determined in the S342 that the grizzly feeder 22 has not been started, the processing operation skips the S343 and proceeds to the S344. If the answer to the above question is NO in the S341, the processing operation skips the S342 and the S343 and proceeds to the S344.

Then, in the S344, it is determined if the reading of the interlock start timer is equal to the grizzly feeder startup time T5 or not. If the answer to this question is YES, the processing operation proceeds to S345, where the forward revolution solenoid for the grizzly feeder 22 is turned ON, and then to S346.

After the above steps, the processing operation makes the reading of the interlock start timer equal to the grizzly feeder startup time T5 and not greater than the grizzly feeder startup time T5 plus 1 in the S346. Thereafter, in S347, the RENDOU_FULL_MOVE_FLAG is made equal to "1" because the interlock start step of the S347 has been completed and then the processing operation proceeds to S350 shown in FIG. 14. As each of the operation units 22, 30, 50, 60 and 80 is started, the corresponding one of the display sections 112 through 117 turns from white to green in the display of the vehicle monitor 96. To the contrary, as each of the operation units is stopped the corresponding one of the display sections turns from green to white, although this process will not be described in greater detail.

Figure 14:
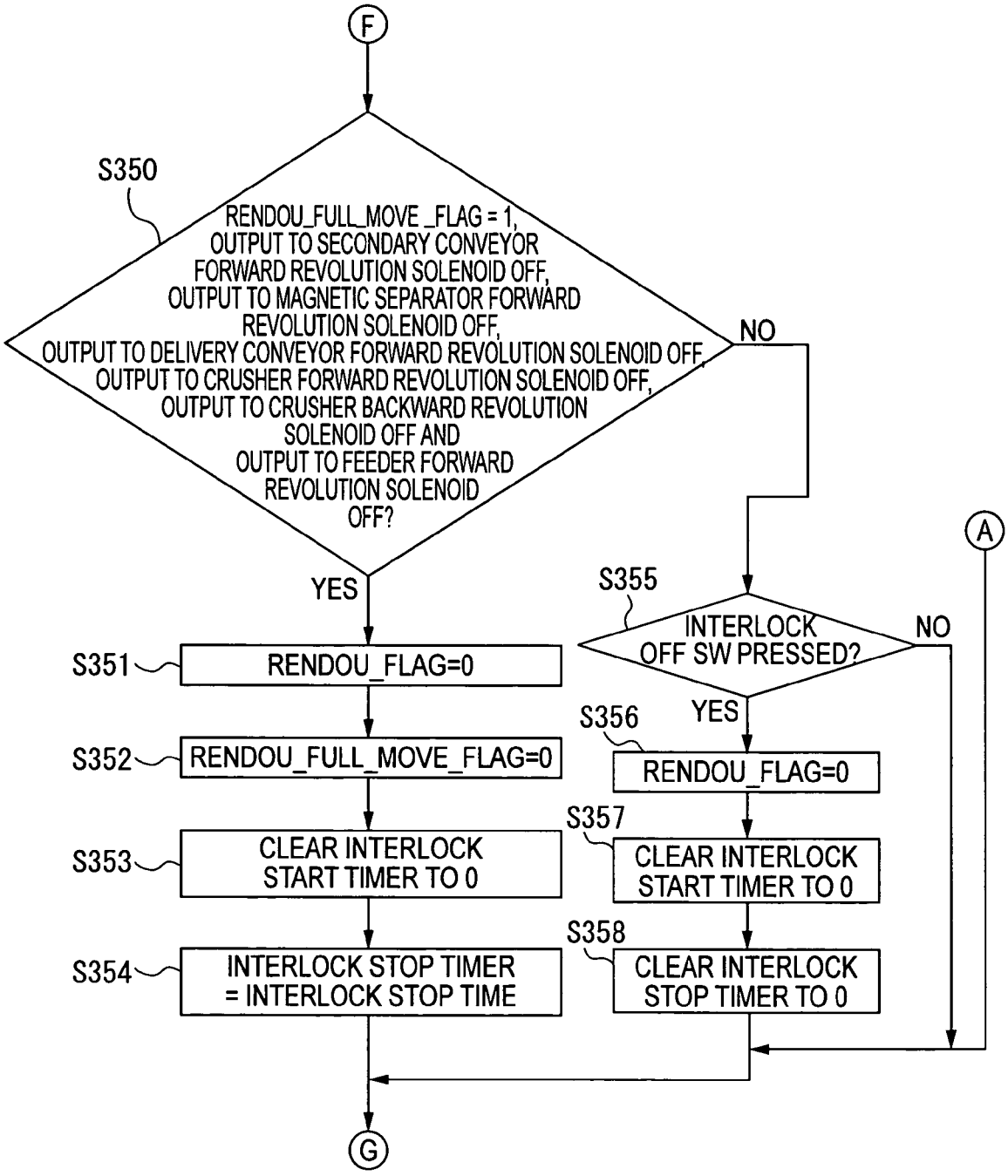
FIG. 14 is a flow chart illustrating a processing operation of determining an interlock flag OFF in the operation mode.

FIG. 14 shows a flow chart for an operation of determining if the RENDOU_FLAG is OFF or not This operation is performed by the interlock stop determining section 125.

Referring to FIG. 14, it is determined in the S350 if the RENDOU_FULL_MOVE_FLAG is equal to "1" (and hence an interlocked operation has been started) and the outputs to the solenoids for all the operation units 22, 30, 50, 60 and 80 are OFF or not. If the answer to theses questions is YES, it is determined that all the outputs are made OFF, for example, for the purpose of a single operation. Therefore, S351 through S354 are executed and the flag for an interlocked operation is reset before the processing operation proceeds to S360 shown in FIG. 15. If, on the other hand, the answer to the above questions is NO, the processing operation proceeds to S355.

In the S355, it is determined if the interlock OFF switch 94 has been pressed or not If the answer to this question is YES, the RENDOU_FLAG is set to "0" in S356 and the interlock start timer is cleared to "0" in S357 before the interlock stop timer is cleared to "0" in S358 and the processing operation proceeds to S360. If, on the other hand, the answer to the question is NO, the processing proceeds directly to S360.

Figure 15:
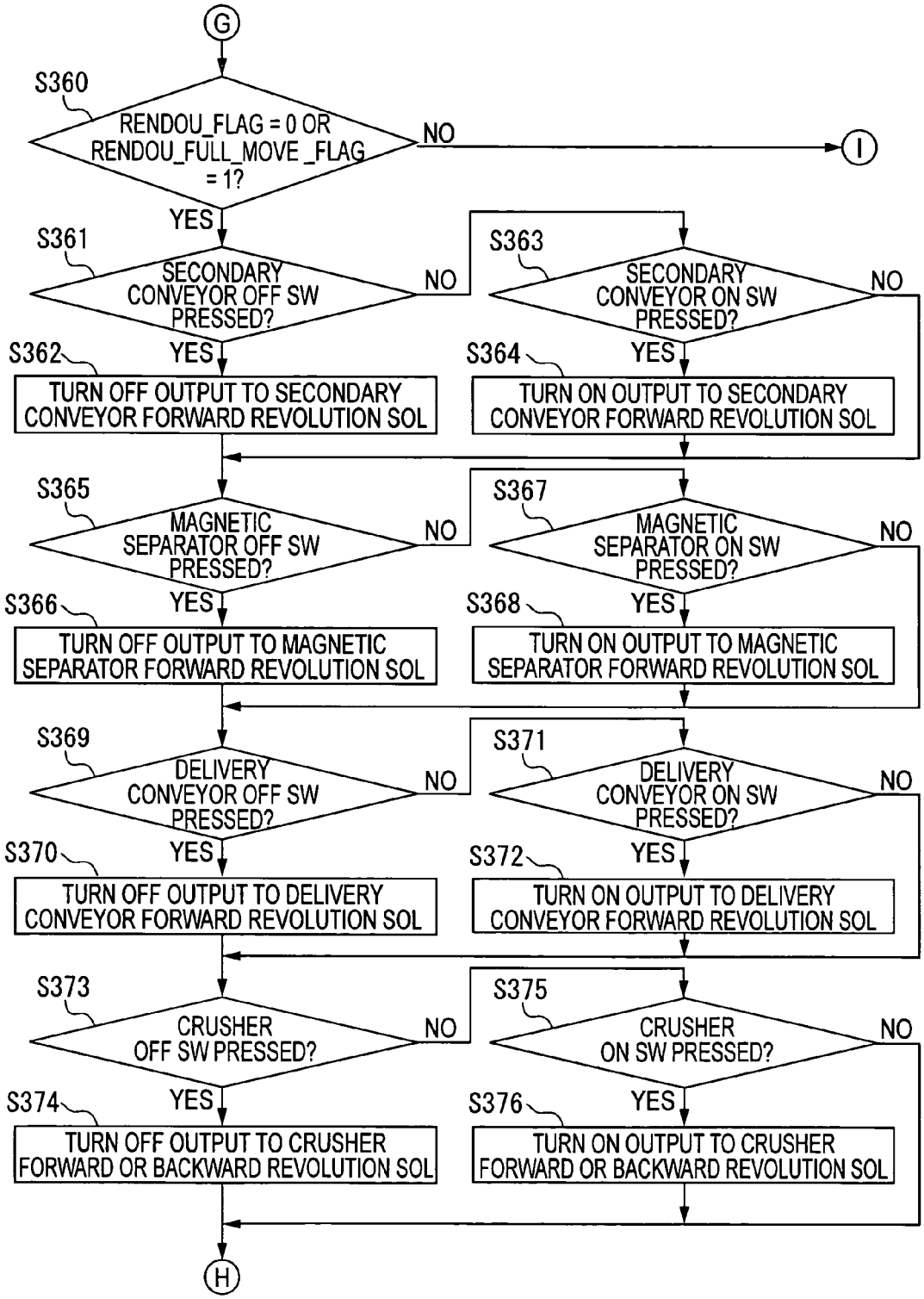
FIG. 15 is a flow chart illustrating a processing operation of a single operation in the operation mode.

FIG. 15 shows a flow chart for the single operation of each of the operation units 22, 30, 50, 60 and 80. The single operation executing section 126 is responsible for the flow of operation.

In the S360, it is determined if the RENDOU_FLAG=0 (a state where no interlocked operation is being conducted) and the RENDOU_FULL_MOVE_FLAG=1 (a state where the interlocked operation has been completed). If the answer to these questions is YES, the processing operation proceeds to S361 where the single operation will be accepted. If, on the other hand, the answer to the questions is NO, the processing operation proceeds to S381 shown in FIG. 16, where an OFF signal for the traveling lock control valve 109 is output to prohibit the crushing system A from traveling and the operation mode is terminated before the processing operation returns to the S200 in FIG. 5. In other words, the crushing system A cannot travel in the operation mode because the S381 is executed as a matter of course while the processing operation of the flow chart is repeated.

Now, the processing operation flow for the single operation of each of the operation units 22, 30, 50, 60 and 80 will be described below, assuming that the answer to the questions in the S360 is YES.

In the S361, it is determined if the secondary conveyor OFF switch is pressed or not. If the answer to this question is YES, the processing operation proceeds to S362, where the output to the forward revolution solenoid of the secondary conveyor 80 is turned OFF. If the answer to the question is NO, the processing operation proceeds to S363.

In the S363, it is determined if the secondary conveyor ON switch is pressed or not. If the answer to this question is YES, the processing operation proceeds to S364, where the output to the forward revolution solenoid of the secondary conveyor 80 is turned ON to operate the solenoid. If the answer to the question is NO, the processing operation proceeds to S365.

In the S365, it is determined if the magnetic separator OFF switch is pressed or not. If the answer to this question is YES, the processing operation proceeds to S366, where the output to the forward revolution solenoid of the magnetic separator 60 is turned OFF. If the answer to the question is NO, the processing operation proceeds to S367.

In the S367, it is determined if the magnetic separator ON switch is pressed or not. If the answer to this question is YES, the processing operation proceeds to S368, where the output for the forward revolution solenoid of the magnetic separator 60 is turned ON to operate the solenoid. If the answer to the question is NO, the processing operation proceeds to S369.

In the S369, it is determined if the delivery conveyor OFF switch is pressed or not. If the answer to this question is YES, the processing operation proceeds to S370, where the output to the forward revolution solenoid of the delivery conveyor 50 is turned OFF. If the answer to the question is NO, the processing operation proceeds to S371.

In the S371, it is determined if the delivery conveyor ON switch is pressed or not If the answer to this question is YES, the processing operation proceeds to S372, where the output for the forward revolution solenoid of the delivery conveyor 50 is turned ON to operate the solenoid. If the answer to the question is NO, the processing operation proceeds to S373.

In the S373, it is determined if the crusher OFF switch is pressed or not. If the answer to this question is YES, the processing operation proceeds to S374, where the output to the forward or backward revolution solenoid of the crusher 30 is turned OFF. If the answer to the question is NO, the processing operation proceeds to S375.

Figure 16:
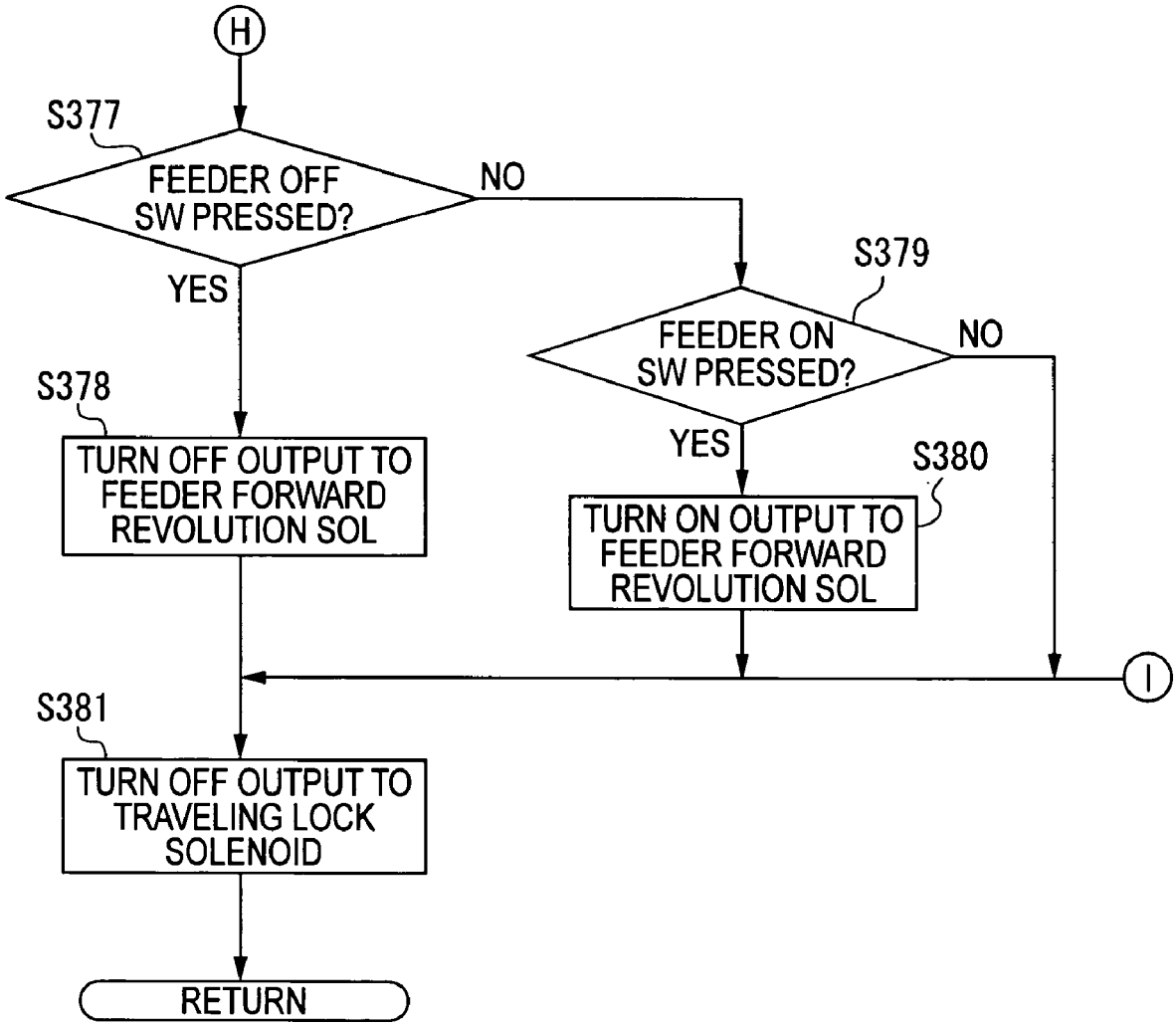
FIG. 16 is a flow chart immediately succeeding the processing operation of the single operation in FIG. 15.

In the S375, it is determined if the crusher ON switch is pressed or not. If the answer to this question is YES, the processing operation proceeds to S376, where the output for the forward or backward revolution solenoid of the crusher 30 is turned ON to operate the solenoid. If the answer to the question is NO, the processing operation proceeds to S377 (FIG. 16).

Although not shown in the figure, a signal from the forward revolution/backward revolution changeover switch of the crusher 30 is input to the controller 91 so that it is determined according to the input signal if the forward revolution solenoid or the backward revolution solenoid of the crusher 30 are respectively either turned ON/OFF or OFF/ON.

In the S377, it is determined if the grizzly feeder OFF switch is pressed or not. If the answer to this question is YES, the processing operation proceeds to S378, where the output to the forward revolution solenoid of the grizzly feeder 22 is turned OFF. If the answer to the question is NO, the processing operation proceeds to S379.

In the S379, it is determined if the grizzly feeder ON switch is pressed or not If the answer to this question is YES, the processing operation proceeds to S380, where the output for the forward revolution solenoid of the grizzly feeder 22 is turned ON to operate the solenoid. If the answer to the question is NO, the processing operation proceeds the S381.

Figure 17:
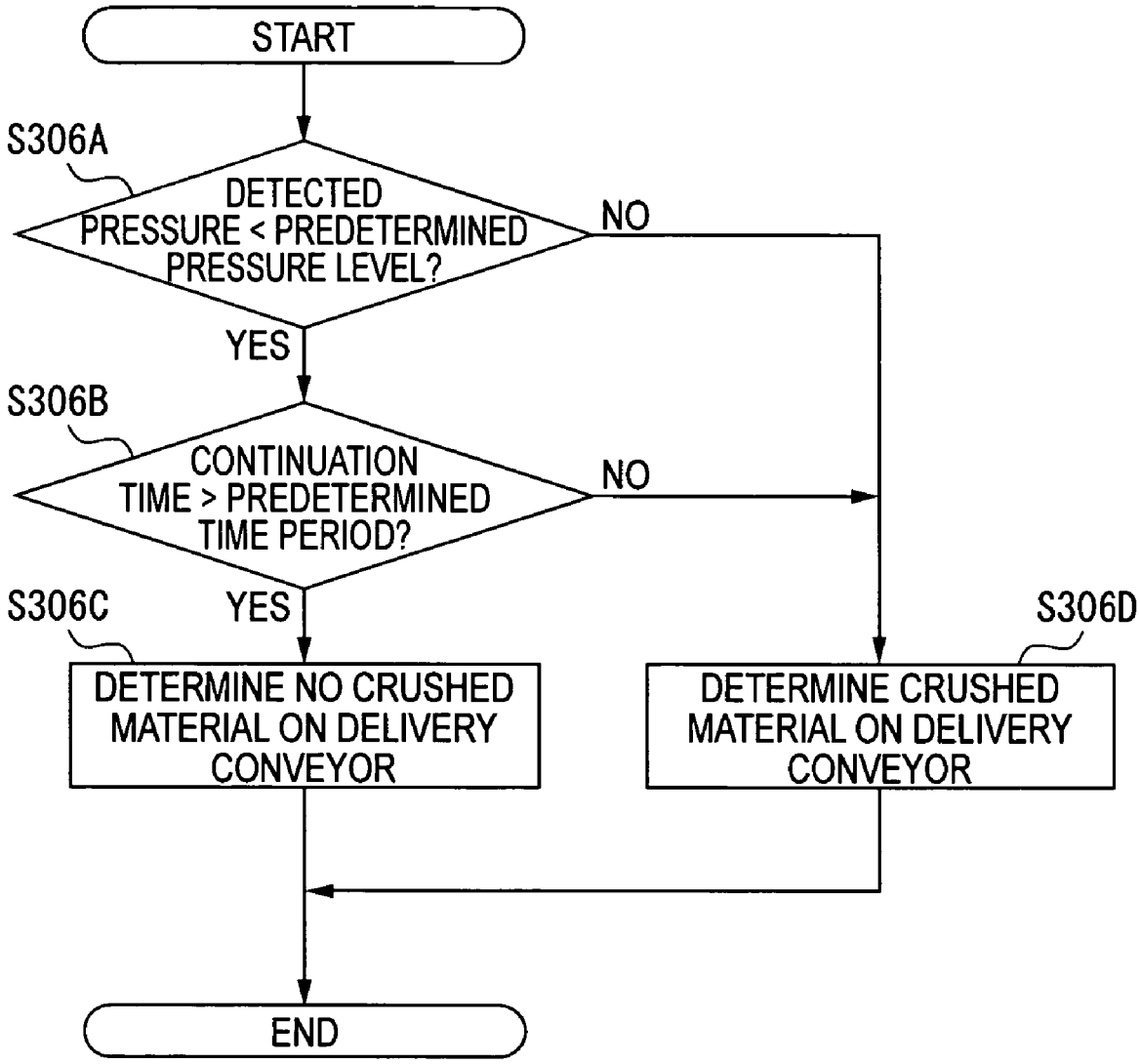
FIG. 17 is a first flow chart specifically illustrating the processing operation of detecting a load of the operation unit.
Figure 18:
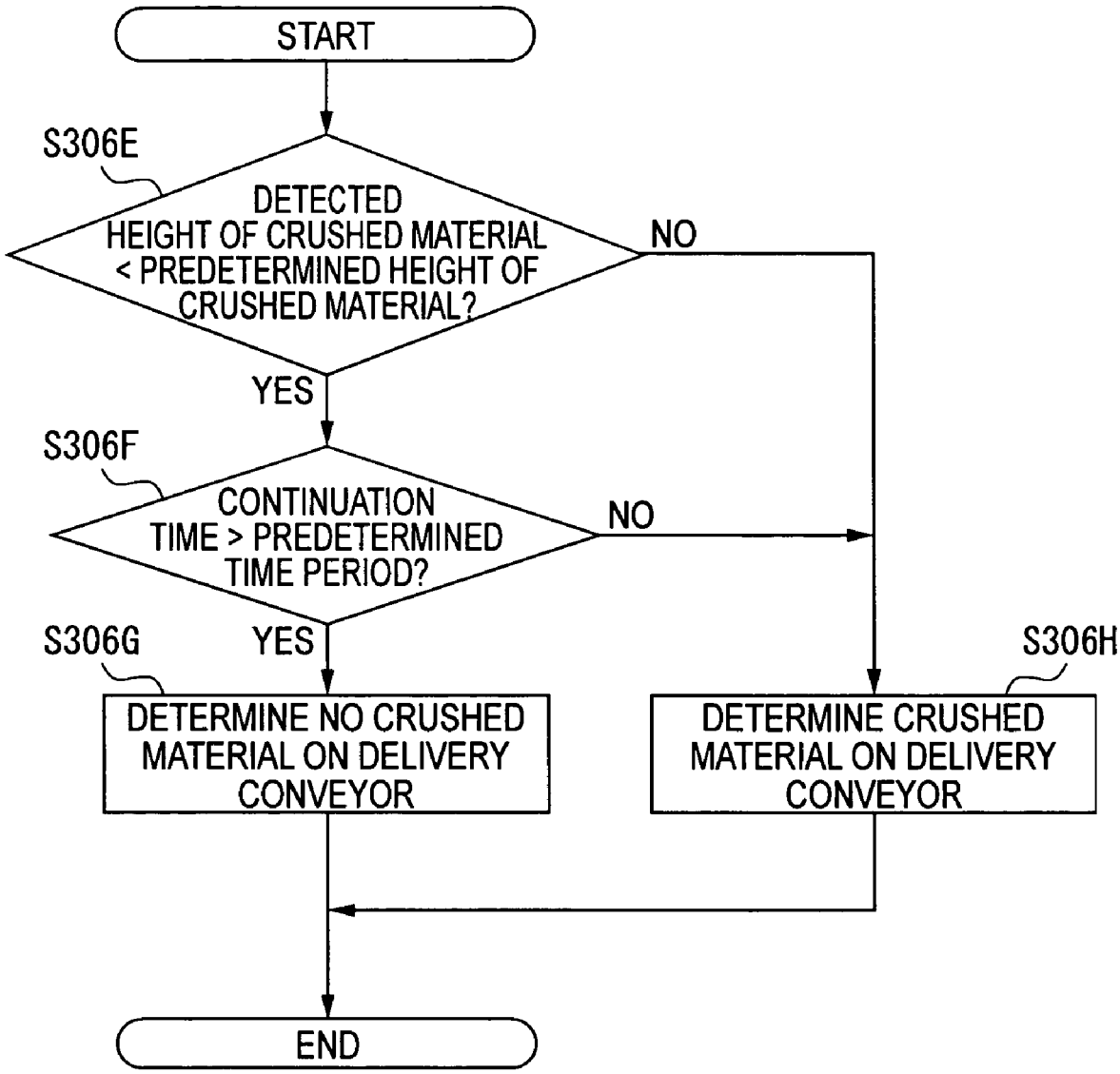
FIG. 18 is a second flow chart specifically illustrating the processing operation of detecting the load of the operation unit.
Figure 19:
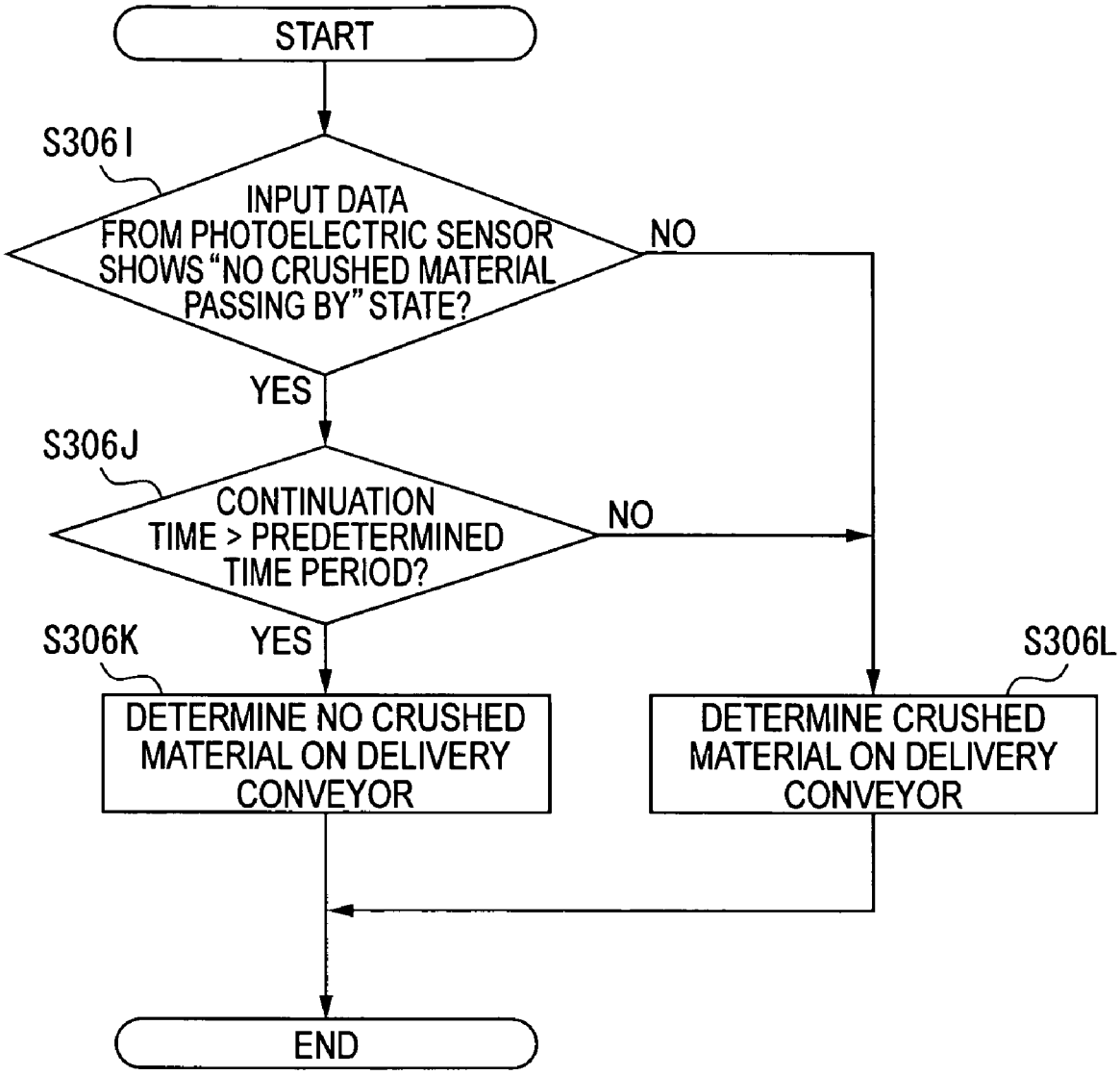
FIG. 19 is a third flow chart specifically illustrating the processing operation of detecting the load of an operation unit.

FIGS. 17 through 19 specifically show the first through third flow charts that can be used to the determining section 122A shown in FIG. 4 to determine if any crushed material is found on the delivery conveyor 50 or not.

The first flow chart illustrated in FIG. 17 can be used to determine if any crushed material is found on the delivery conveyor 50 or not by the load detector 110 for the delivery conveyor 50.

Firstly in S306A, it is determined if the pressure detected by the load detector 110 of the delivery conveyor 50 is lower than the pressure level (activation pressure) that is predetermined for a condition where no crushed material is found on the delivery conveyor 50 while the output to the solenoid of the delivery conveyor 50 is ON. If the answer to this question is YES, the processing operation proceeds to S306B, where it is determined if the state where the detected pressure is lower than the predetermined pressure level has continued for a time period exceeding a predetermined reference time period or not If the answer to this question is YES, it is determined in S306C that no crushed material is found on the delivery conveyor 50. If, on the other hand, it is determined in the S306A that the detected pressure is higher than the predetermined pressure level or in S306B that the detected pressure is lower than the predetermined pressure level but such state has not continued for a time period exceeding the predetermined reference time period, the processing operation proceeds to S306D, where it is determined that the crushed material is found on the delivery conveyor 50.

The expression of the "predetermined pressure level" as used herein refers to the pressure level that is detected when no crushed material is found on the delivery conveyor 50. It may show a predetermined value that is empirically determined or a value that can be modified appropriately by way of a determined pressure input section or the like. The expression of "predetermined time period" as used herein refers to a time period that is sufficient for determining that no crushed material is found on the delivery conveyor 50. The predetermined time period may show a constant value or a value that can be modified appropriately by way of a determined time period selecting section or the like.

The second flow chart illustrated in FIG. 18 can be used to determine if any crushed material is found on the delivery conveyor 50 or not by an ultrasonic sensor (load detector) installed on the delivery conveyor 50. Such an ultrasonic sensor is typically arranged upstream relative to the delivery end side of the delivery conveyor 50 and adapted to transmit an ultrasonic wave from upstream toward the delivery conveyor 50 located downstream and receive the wave reflected by the crushed material, if any, on the delivery conveyor 50. The obtained data on the reflected wave is input to the controller 91 (FIG. 2) to detect the height of the crushed material on the delivery conveyor 50, if any.

Referring to FIG. 18, in S306E, it is determined if the height of the crushed material as detected on the basis of the data obtained from the ultrasonic sensor, while the output to the solenoid for the delivery conveyor 50 is ON, is smaller than a predetermined value that corresponds to a situation where no crushed material is found on the delivery conveyor 50 or not. If the answer to this question is YES, the processing operation proceeds to S306F, where it is determined if the state where the detected height is smaller than the predetermined value has continued for a time period exceeding a predetermined reference time period or not. If the answer to the latter question is also YES, the processing operation proceeds to S306G, where it is determined that no crushed material is found on the delivery conveyor 50. If, on the other hand, it is determined in the S306E that the detected height of the crushed material is greater than the predetermined value or in the S306F that the state where the detected height is smaller than the predetermined value has not continued for the predetermined reference time period, the processing operation proceeds to S306H, where it is determined that the crushed material is found on the delivery conveyor 50.

The expression of the "predetermined height" may refer to a constant value that corresponds to a situation where no crushed material is found on the delivery conveyor 50 or a value that can be modified appropriately by a predetermined height input section or the like. The expression of the "predetermined time period" as used herein is same as the above defined corresponding expression and, whenever appropriate, the definition applies to the following description.

The third flow chart illustrated in FIG. 19 can be used to determine if any crushed material is found on the delivery conveyor 50 or not by a photoelectric sensor (load detector) installed on the delivery conveyor 50. Such a photoelectric sensor of, for instance, a transmissive type is typically arranged at the delivery end side of the delivery conveyor 50. The sensor has a light emitting element arranged at a lateral side of the delivery conveyor 50 and a light receiving element arranged at the opposite lateral side of the delivery conveyor 50 so that the light emitted from the light emitting element may cross the passageway of the crushed material. If the light emitted from the light emitting element is blocked by the crushed material that is being delivered and does not reach to the light receiving element, a signal representing the situation is input to the controller 91 (FIG. 2). If, on the other hand, the light emitted is not blocked and reaches to the light receiving element, a signal representing the fact that no crushed material is found on the delivery conveyor 50 is input to the controller 91.

Referring to FIG. 19, in S306I, it is determined if there exists a state where no crushed material is passing by the photoelectric sensor or not on the basis of the input to the photoelectric sensor, while the output to the solenoid of the delivery conveyor 50 is ON. If no crushed material is detected and the answer to the above question is YES, the processing operation proceeds to S306J, where it is determined if the state where no crushed material is passing by has continued for a time period exceeding a predetermined reference time period or not. If the answer to the question is YES, the processing operation proceeds to S306K, where it is determined that there is no crushed material found on the delivery conveyor 50. If, on the other hand, it is determined in the S306I that some crushed material is passing by or in the S306J that the state where no crushed material is passing by has not continued for a time period exceeding the predetermined reference time period, the processing operation proceeds to S306L where it is determined that there is the crushed material found on the delivery conveyor 50.

Figure 5:
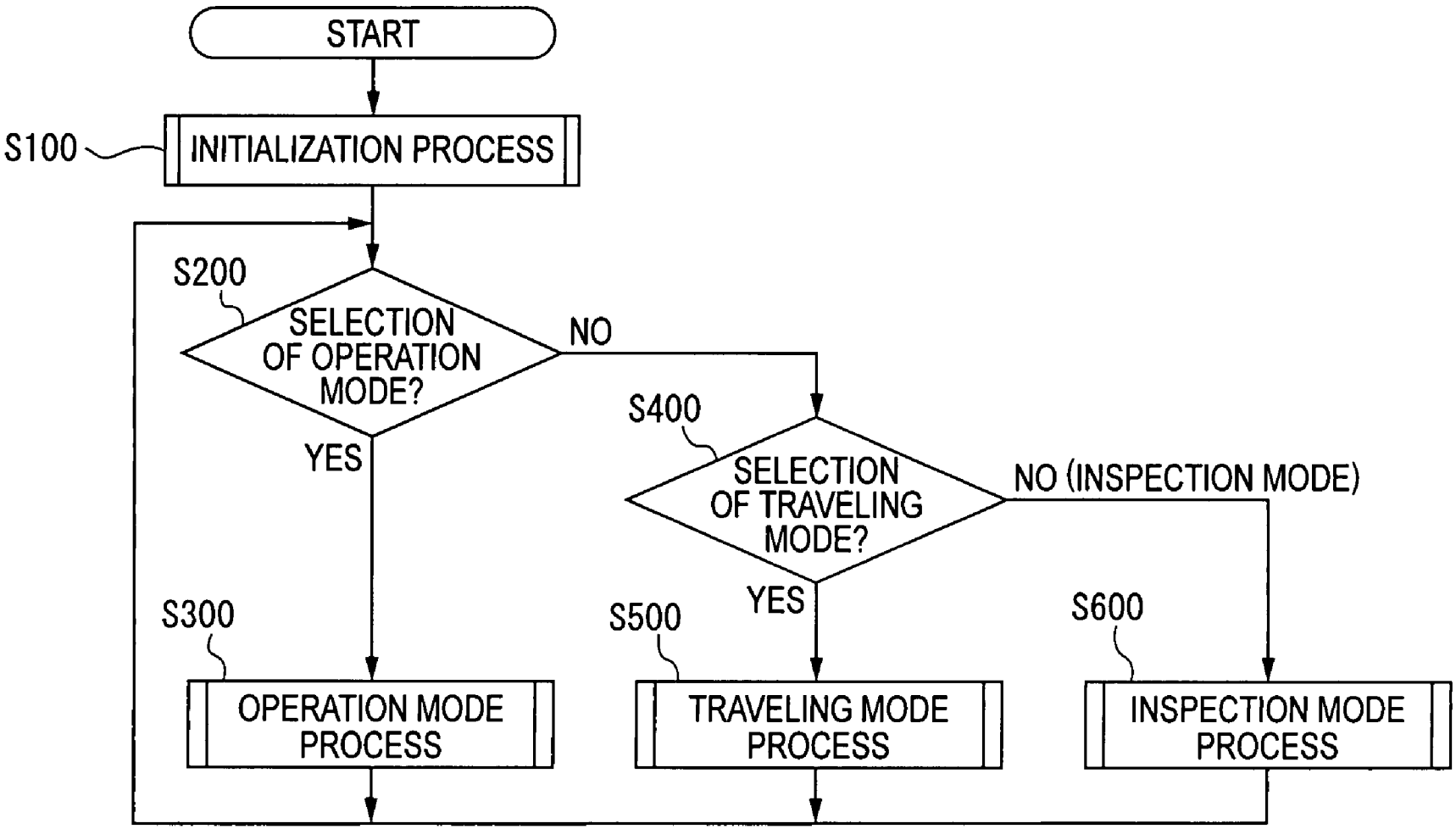
FIG. 5 is a flow chart showing a basic computer program executed in the controller.
Figure 20:
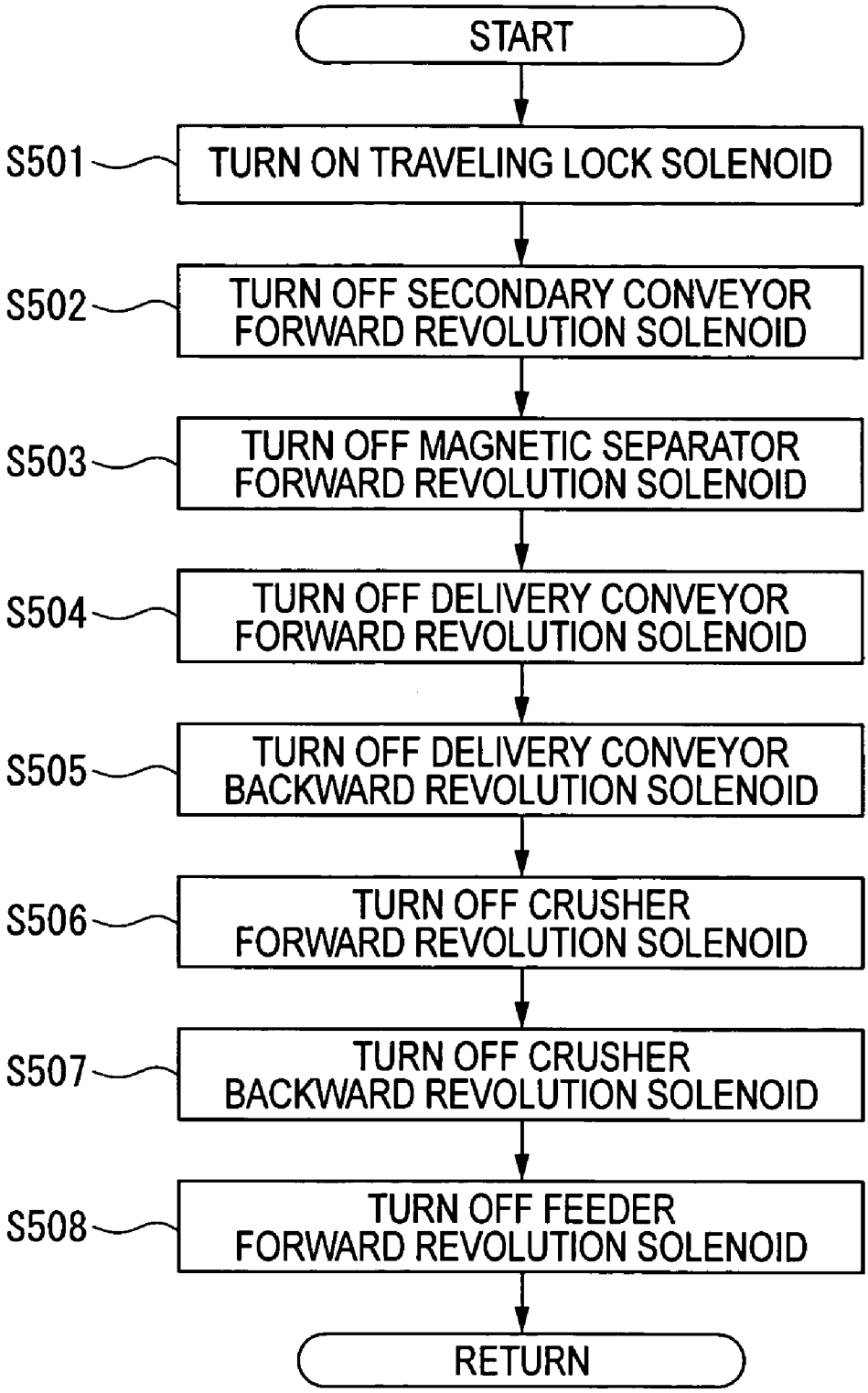
FIG. 20 is a flow chart illustrating the processing operation in a traveling mode.

FIG. 20 illustrates a flow chart for a processing operation that is performed in the traveling mode of S500 (FIG. 5). This operation is performed by the traveling mode executing section 127.

Referring to FIG. 20, in S501, the output to the solenoid of the control valve 109 for traveling is turned ON so as to allow the crushing system A to travel. In S502 through S508, all the operation units 22, 30, 50, 60 and 80 are prohibiting from operating and held to a stopped condition. Under this condition, the output to the solenoid of the lower traveling bodies 11 is turned ON by operating the traveling levers 13.

Finally, S600 is provided for a processing operation in the inspection mode. While this is not illustrated in detail, the crusher 30 is manually operated by the manual forward revolution or backward revolution changeover switch for the crusher and the delivery conveyor 50 is manually operated by the manual forward revolution or backward revolution changeover switch for the delivery conveyor, while the outlet port of the crusher 30 is regulated by the outlet port opening or closing switch.

The described above embodiment provides the following advantages.

(1) In the crushing system A composed of a self-propelled crushing machine 1, the grizzly 70 and the secondary conveyor 80, the interlocked operation of the operation units 22, 30, 50, 60, 70 and 80 is stopped by pressing the interlock OFF switch 94 of the control unit 90. For this stopping operation, after stopping the grizzly feeder 22, the load of the delivery conveyor 50 is detected by the load detector 110 and it is determined if the load is cleared and no crushed material is left on the delivery conveyor 50 by the determining section 122A. Only thereafter, the stop command signal is output from the stop command section 122B to the respective operation units 30, 50, 60, 70 and 80. Thus, if compared with the conventional arrangement of stopping the operation units only after the elapse of a predetermined time period, this arrangement can reliably prevent any crushed material from remaining on the delivery conveyor 50 so that it is no longer necessary to worry about a situation where the crushed material remaining on the delivery conveyor 50 has to be removed.

(2) The load, if any, of the delivery conveyor 50 that is arranged downstream relative to the crusher 30 is detected to reliably determine if there is any crushed material remaining on the delivery conveyor 50 or not. Thus, it is now possible to prevent any crushed material from remaining in the narrow space between the crusher 30 and the delivery conveyor 50 that can be easily clogged so as to avoid a time consuming cumbersome operation of removing the crushed material remaining there.

(3) Additionally, the load of the delivery conveyor 50 is detected and the magnetic separator 60, the grizzly 70 and the secondary conveyor 80 that are arranged downstream relative to the delivery conveyor 50 are substantially simultaneously stopped when the load of the delivery conveyor 50 is cleared out. Thus, it is no longer necessary to drive the operation units 60, 70 and 80 until the load of the delivery conveyor 50 is cleared and/or idly drive the crusher 30 and the delivery conveyor 50. Therefore, fuel and oil are prevented from being wasted.

(4) Furthermore, when the crushing system A is started for the interlocked operation, the secondary conveyor 80, the grizzly 70, the magnetic separator 60, the delivery conveyor 50, the crusher 30 and the grizzly feeder 22 are sequentially started from downstream in the above mentioned order. Thus, there is no risk of supplying the raw material or the crushed material to the crusher 30 and the delivery conveyor 50 that has not been started and hence the problem of clogging at the startup time can be reliably avoided.

(5) Still additionally, while the operation units 30, 50, 60, 70 and 80 that are located downstream relative to the grizzly feeder 22 may be started simultaneously if the grizzly feeder 22 has not been started, the operation units 30, 50, 60, 70 and 80 are sequentially started so that, there is no risk that the hydraulic pressure rises excessively high at the startup time and the load on the hydraulic pump 42 etc. is reliably lessened.

(6) When starting the crushing system A in the interlocked operation mode, each of the operation units 22, 30, 50, 60, 70 and 80 is not allowed to operate individually until starting to operate in a completely interlocked manner (see the S360 in FIGS. 8 and 15). Therefore, for instance, any attempt for starting the grizzly feeder 22 alone before the startup of the crusher 30 is not allowed in the interlocked mode. Thus, any problem of clogging is prevented from taking place before startup.

(7) When an operator tries to realize the operating condition of one of the operation units by hearing the sound it emits, the sound may be drowned by ambient noises to baffle the effort. However, with this embodiment, the operating condition of each of the operation units 11, 22, 30, 50, 60 and 80 is displayed on the corresponding one of the display sections 111 through 117 of the vehicle monitor 96 so that the operator can visually and intuitively confirm the operating condition. Such a monitor may be installed in the loader 2 and also in the management office so as to receive information from the control unit 90 and remotely display the operating condition of each of the operation units.

The present invention is by no means limited to the described above embodiment, configuration of which may be modified or altered without departing from the spirit and scope of the present invention as will be described below as examples.

For example, the load of the delivery conveyor 50 is detected by the load detector 110 and the crusher 30 and other downstream operation units 50, 60, 70 and 80 are stopped when the load is cleared out in the above-described embodiment. However, it may alternatively be so arranged that the load detector 110 detects the load of the secondary conveyor 80 that is located at the most downstream position in the crushing system A and the crusher 30 and other operation units are stopped when the load is cleared out With this arrangement, it is no longer necessary to remove the crushed material, because no crushed material is remaining on the crusher 30 and other operation units located downstream relative to the crusher 30.

Still alternatively, it may be so arranged that the load of the grizzly 70 is detected instead the load of the delivery conveyor 50 or that of the secondary conveyor 80 before stopping the operation units. If a tertiary conveyor or the like is provided, the load of the tertiary conveyor may be detected. Thus, the operation unit whose load is detected before stopping all the operation units may be appropriately selected on the basis of the operation condition of the crushing system A.

While the crushing system A composed of the self-traveled crushing machine 1 that carries the grizzly feeder 22 and the crusher 30 in the above embodiment, a crushing system according to the present invention may alternatively be made to have a stationary feeder and a stationary crusher.

The magnetic separator 60, the grizzly 70 and the secondary conveyor 80 of the above described embodiment may be omitted whenever appropriate. In other words they may be installed only when they are necessary.

While the present invention is described above in terms of the best mode for carrying it out and processing procedure, it is by no means limited thereto. While the present invention is illustrated and described above by way of a specific embodiment, it will be clear to those skilled in the art that the above described embodiment may be modified or altered in various different ways in terms of shape, material, number, processing procedure and so on without departing from the spirit and scope of the invention.

Therefore, the above description is specifically made in terms of shape, material and so on only to clarify the present invention and hence it does not limit the scope of the present invention. In other words, the description made above specifically or non-specifically in terms of shape, material, processing procedure and so on is covered by the present invention.

What is claimed is:

1. A crushing system comprising:

a plurality of operation units, including a crusher, which are operable to operate together in interlocked operation;

a load detector for outputting a detection signal indicating a load of at least one of the plurality of operation units;

a stop device for stopping the interlocked operation of the plurality of operation units;

a determining section for determining a presence of the load of at least one of the plurality of operation units based on the detection signal from the load detector; and a stop command section that outputs a stop command signal to each of the plurality of operation units in a predetermined order when the determining section determines that no load is applied on the at least one of the plurality of operation units after the stop device is operated.

2. The crushing system according to claim 1, wherein said at least one of the operation units comprises at least one operation unit arranged downstream relative to the crusher.

3. The crushing system according to claim 2, wherein said at least one of the operation units comprises a delivery conveyor arranged immediately downstream relative to the crusher.

4. The crushing system according to claim 2, wherein said at least one of the operation units comprises an operation unit that is arranged most downstream among the plurality of operation units.

5. The crushing system according to claim 1, wherein:

the load detector detects a hydraulic pressure on the at least one of the operation units; and the determining section compares a preset predetermined pressure with a detected pressure detected by the load detector and determines that the crushing system is in an abnormal state if the detected pressure does not remain lower than the predetermined pressure for a predetermined time period.

6. The crushing system according to claim 5, wherein the load detector comprises at least one pressure sensor arranged on a hydraulic circuit located on an inlet port side of respective hydraulic motors of one of the crusher and the delivery conveyor.

7. The crushing system according to claim 1, wherein:

the load detector optically detects presence of crushed material piled from any one of the operation units; and the determining section determines that the crushing system is in an abnormal state if the piled crushed material is not absent for a predetermined time period.

8. The crushing system according to claim 1, wherein the stop device, the stop command section, the load detector and the determining section are provided on a control unit.

9. The crushing system according to claim 8, wherein:

the control unit comprises a controller executing a predetermined program;

the stop command section and the determining section are respectively comprise a program executed by the controller; and the stop device and the load detector are connected to the controller.

10. The crushing system according to claim 9, wherein the stop device is an interlock OFF switch connected to the controller, and control sections for controlling the interlocked operation based on operation of the interlock OFF switch are provided on the controller.

11. The crushing system according to claim 8, wherein the control unit comprises a traveling lock control valve for restricting traveling of the crushing system when any one of the operation units is operating.

12. The crushing system according to claim 11, wherein the traveling lock control valve comprises a traveling block control valve for blocking a hydraulic circuit for traveling corresponding to each operation status of the operation units respectively controlled by the control unit.

13. A crushing system comprising:

a plurality of operation units, including a crusher, which are operable to operate together in interlocked operation;

a stop device for stopping the interlocked operation of the operation units;

a stop command section for outputting a respective stop command signal to each of the plurality of operation units in a predetermined order in response to operation of the stop device;

a load detector for detecting a load of at least one of the plurality of operation units; and a determining section for determining the load of each operation unit having a load detected by the load detector, based on a detection signal from the load detector;

wherein the stop command section outputs the respective stop command signal to at least one of the plurality of operation units on the determination made by the determining section;

wherein the load detector detects a height of a crushed material piled from any one of the operation units; and wherein the determining section compares a preset predetermined height with a detected height and determines that the crushing system is in an abnormal state if the detected height does not remain smaller than the predetermined height for a predetermined time period.

* * * * *